US006072455A

United States Patent [19]

Matsui et al.

[11] Patent Number: 6,072,455

[45] Date of Patent: Jun. 6, 2000

[54] DRIVING METHOD FOR LIQUID CRYSTAL DEVICE

[75] Inventors: Eriko Matsui; Nobue Kataoka, both of Kanagawa; Akio Yasuda, Tokyo, all of Japan

[73] Assignee: Sony Corporation, Tokyo, Japan

[21] Appl. No.: 08/923,403

[22] Filed: Sep. 6, 1997

[30] Foreign Application Priority Data

Sep. 6, 1996 [JP] Japan ..... 8-257864

[51] Int. Cl.[7] ..... G09G 3/36

[52] U.S. Cl. ..... 345/97; 345/87; 345/94

[58] Field of Search ..... 345/97, 87, 94, 345/92, 98, 100

[56] References Cited

U.S. PATENT DOCUMENTS 5,863,458 1/1999 Miyata et al. ..... 345/97

5,886,678 3/1999 Katakura et al. ..... 345/97

5,900,852 5/1999 Tanaka et al. ..... 345/87

*Primary Examiner*—Richard A. Hjerpe

*Assistant Examiner*—Kimnhung Nguyen

*Attorney, Agent, or Firm*—Ronald P. Kananen, Esq.; Rader, Fishman, & Grauer PLLC

[57] ABSTRACT

A driving method for a liquid crystal device includes the steps of providing a first substrate with a unidirectionally aligned data electrode group and a second substrate with a select-electrode group aligned perpendicularly to the data electrode; applying a select pulse to the select electrodes; and providing a pause corresponding to at least one line before a data-pulse sequence is applied to the data-electrode group. The select pulse can be synchronized with the data-pulse sequence by shifting them a half line relative to each other so that the select pulse and the data pulse have opposite polarity in relation to each other. Alternatively, the select pulse is applied while the data pulse sequence is applied to the data electrode group. In the latter case, the time and/or voltage is determined so as to offset the effects of the reversed electric field generated during switching of the liquid crystal.

14 Claims, 22 Drawing Sheets

$$\left( E_{gap} = \frac{V_{gap}}{d_{gap}} \right)$$

$$d_1 + d_2 = d_{gap}$$

$$E_{eff} = \frac{\epsilon_2}{\epsilon_1 d_2 + \epsilon_2 d_1} \times V_{gap} \cdots\cdots (1)$$

$\epsilon_1$ : DIELECTRIC CONSTANT OF LIQUID CRYSTAL $\epsilon_2$ : DIELECTRIC CONSTANT OF FINE PARTICLE ADDITIVE

DRIVING METHOD FOR LIQUID CRYSTAL DEVICE

BACKGROUND OF THE INVENTION

1. Field of the Invention

The present invention relates to a driving method for a liquid crystal device, e.g. a liquid crystal display, in which a liquid crystal is disposed between a first substrate provided with a unidirectionally aligned data-electrode group and a second substrate provided with a select electrode group aligned perpendicularly to said data-electrodes.

2. Description of the Related Art

Liquid crystal displays (LCDs), using liquid crystals as displays, have several -advantages, e.g. low electric consumption and thin and lightweight appearances, and have been widely used in clocks, watches, electronic calculators, computer displays and television (TV) sets.

Use of ferroelectric liquid crystals (FLC) in LCDs has been intensively studied. Meyer first synthesized a FLC in 1975, and Clark and Lagerwall invented a surface stabilized FLC capable of domain inversion by an electric field in 1980. A FLC molecules has a permanent dipole moment perpendicular to the longitudinal axis of the molecule, produces spontaneous polarization, and is capable of switching by means of an electric field. FLC displays have the following advantages:

(1) They respond 1000 times faster than twisted nematic (TN) liquid crystal displays due to $\mu$-second switching rates;

(2) They have large angles of visible field because the molecules do not basically form twisted structures; and (3) They can maintain an image when they are de-energized, have memory effects of the image, and are capable of passive-matrix driving of 1,000 or more scanning lines in high definition TVs.

Therefore, FLC displays are suitable for trends required for displays toward high definition, low cost, and large screens.

A typical FLC display has a configuration as schematically shown in FIGS. 1 and 2. Transparent electrode groups 2*a* and 2*b*, which are composed of indium tin oxide (ITO) with a surface resistivity of 100 Ω, are provided on transparent glass substrates (Corning 7059, 0.7 mm thick) 1*a* and 1*b*, respectively. The transparent electrode group 2*a* is provided as a data electrode (column electrode) group and the transparent electrode group 2*b* is provided as a scanning electrode (row electrode) group. Each electrode group is patterned into a stripe by etching, and the two electrode groups 2*a* and 2*b* are perpendicularly arranged in relation to each other.

Rhombic SiO deposited films 3*a* and 3*b* are formed as liquid crystal alignment films on the transparent electrode groups 2*a* and 2*b*, respectively. In order to form SiO rhombic deposited films, each substrate is disposed just above a SiO deposition source in a vacuum evaporation system, so that the angle between the normal line of the substrate and the vertical line from the deposition source is 85 degrees. After SiO is deposited on the substrate at a temperature of 170° C., the substrate is baked at 300° C. for 1 hour.

A pair of substrates 1*a* and 1*b* having alignment films are assembled so that the data-electrode group 2*a* and the scanning electrode group 2*b* are perpendicular to each other and directions of alignment treatment of the two electrode groups are antiparallel. Glass beads 4 (diameter: 0.8 to 3.0 $\mu$m, made by Catalysts & Chemical Industries Co., Ltd.) are used as spacers to secure a given gap distance. Although the directions of alignment treatment are antiparallel in this case, two substrates can also be assembled so that the directions are parallel.

In substrates having small areas, the gap between the two substrates is controlled to a given distance such that spacers 4 having a desirable diameter are dispersed into a sealing agent 6 (a UV curable bonding agent, trade name: Photorec made by Sekisui Chemical Co., Ltd.), which is used for bonding the peripheries of the substrates, in an amount of approximately 0.3 percent by weight. In substrates having large areas, glass beads are distributed on the substrates in an amount of 100 /mm$^2$ to secure a gap, and the periphery of the cell other than an injection port for the liquid crystal is bonded with a sealing agent 6.

A liquid crystal composition, in which, for example, a ferroelectric liquid crystal 5 (YS-C152 made by Chisso Corporation) is homogenized with an ultrasonic homogenizer at an isotropic phase temperature and injected between the two substrates 1*a* and 1*b*. The ferroelectric liquid crystal composition is injected in a flowable state, for example, at an isotropic phase temperature or a chiral nematic phase temperature under a reduced pressure. The injected liquid crystal is gradually cooled, the overflowed liquid crystal around the injection port is removed, and the injection port is sealed with an epoxy bonding agent to prepare a FLC display 11.

The FLC display 11 is generally driven by an X-Y passive-matrix system. In the NTSC system, 1H (a scanning time per horizontal scan or a selection time per line) is 63.5 $\mu$sec., and each selection pulse is 63.5/2 $\mu$sec. due to bipolar voltage application in view of the electrical neutralization condition. As shown in FIG. 3, select pulses are applied as a threshold voltage through the row electrode group 2*b* and data-pulse sequences are applied through the column electrode groups 2*a*.

In ferroelectric liquid crystal devices, e.g. surface stabilized ferroelectric liquid crystal devices, the alignment direction of a molecule M switches between two states, i.e., state 1 and state 2 shown in FIG. 4, in response to the external electric field E (in FIG. 4, the symbol Ps represents spontaneous polarization). Such a change in molecular alignment results in a change in transmittance when the liquid crystal device is provided between two polarizers perpendicular to each other, as shown in FIG. 5, in which the transmittance steeply changes from 0% to 100% at a threshold voltage $V_{th}$ of the applied voltage. The voltage width in the transmittance transition region is generally 1 V or less.

As de scribed above, in a ferroelectric liquid crystal display using a conventional bistable mode, only these two states are stable, and thus it is difficult to hold a stable intermediate transmittance. Gradation display by means of voltage control therefore is achieved with difficulty or cannot be achieved.

Some gradation methods are proposed, i.e., an a real gradation method in which the gradation of an image is adjusted with subpixels, and a time integration gradation method in which gradation is performed by repeated switching operations in one field. These methods, however, do not achieve satisfactory gradation display and result in high production cost because the gradation display is not performed in one pixel.

Analog gradation methods proposed for performing gradation in one pixel include methods for imparting a localized gradient to the field intensity by means of a change in the distance between the opposing electrodes in one pixel or a change in the thickness of the dielectric layer formed between the opposing electrodes; and methods for imparting a gradient to the voltage by means of the change in the electrode material. Production of liquid crystal display devices having practical analog gradation characteristics by means of the above-mentioned methods, however, requires complicated processes and severely controlled production conditions, and results in high production cost.

The ferroelectric liquid crystal display is driven by a passive X-Y matrix system at a run time of, for example, 63.5 μsec. for the NTSC system and a selection pulse width of 63.5/2 μsec. as shown in FIG. 3, because a bipolar voltage is applied instead of a DC voltage. Selection pulses as a threshold voltage are applied through the row electrodes and data-pulse sequences are applied through the column electrodes. The voltage of the data pulses is varied in order to generate a grey scale by the analog gradation as shown in FIG. 6. The data pulses are thereby always applied as bias pulses to th e en tire frame.

The present inventors discovered that the threshold voltage of a pixel shifts with gradations of its adjacent pixels. Such voltage shift is generally noticeable and not negligible in analog gradation display as shown in FIG. 7.

In particular, a voltage corresponding to a reversed electric field remaining in the current display pixel is added to a data pulse which is applied to the next line. A considerably high electric field having opposite polarity is thereby generated and will cause switching in domains having low threshold voltages. That is, the applied voltage including the voltage due to reversed electric field is higher than the threshold voltage.

For example, in a data-pulse sequence DP' in FIG. 10 described in detail below, immediately after switching by a select pulse, a current displaying pixel $PX_{1-1}$ on a line $2b_1$ for displaying a grey level is affected by the reversed electric field when a data pulse is applied to the next line $2b_2$ for displaying a white level, and the grey level of the current displaying pixel $PX_{1-1}$ will change to a black level by means of the data pulse for the next line.

The present inventors recognize that the effect of the following lines and in particular the next line on the gradation of the current displaying pixel is a factor greatly inhibiting analog gradation display.

Liquid crystal compositions having high bias voltage stability have been developed in view of improving the anisotropic dielectric constant, in order to reduce the effect of the data voltage in the passive matrix. It is, however, important to prevent the reversed electric field generated by spontaneous polarization of the composition in order to reduce the effect of the next line.

Liquid crystal display devices must satisfy many characteristics other than the gradation, such as a operational temperature range, a preservation temperature range, contrast, a response speed, a hysteresis width and a threshold voltage width generating a gradation. Control of the effects due to the bias voltage by the composition is therefore limited. Herein, the term "hysteresis" means lagging of transmittance behind applied field intensity.

The present inventors have studied the above-mentioned phenomenon and discovered that one of effects of the bias pulse is a reversed electric field which is generated by the memory effect of the spontaneous polarization of the ferroelectric liquid crystal. The phenomenon will now be described in detail.

FIG. 8 is a graph illustrating the change in transmittance of one pixel in a liquid crystal display device when the color of the adjacent pixel in the next line is changed. As shown in FIG. 8, the transmittance noticeably varies with the data voltage of the next line. The results demonstrate that the transmittance cannot be uniquely determined by the applied voltage and thus the number of gradations decreases.

It has been generally considered that anisotropy in the dielectric constant of liquid crystal molecules having memory effects causes adverse effects of the bias voltage. The present inventors, however, have discovered that transmittance is affected primarily by spontaneous polarization rather than the anisotropic dielectric constant.

SUMMARY OF THE INVENTION

It is an object of the present invention to provide a driving method of a liquid crystal device in which adverse effects of the next line due to a bias voltage or a bias pulse is reduced or eliminated and satisfactory gradation display having a low hysteresis is achieved.

It is another object of the present invention to provide a driving method of a liquid crystal device in which the transmittance is not noticeably affected by a bias voltage or bias pulse and satisfactory gradation display having a low hysteresis is achieved.

A driving method of a liquid crystal device in accordance with a first aspect of the present invention comprises a first substrate provided with a unidirectionally aligned data-electrode group and a second substrate provided with a select-electrode group aligned perpendicularly to the data electrode, wherein after a select pulse is applied to the select electrodes, a pause corresponding to at least one line is provided before a data-pulse sequence is applied to the data-electrode group.

A driving method of a liquid crystal device in accordance with a second aspect of the present invention comprises a first substrate provided with a unidirectionally aligned data-electrode group and a second substrate provided with a select-electrode group aligned perpendicularly to the data electrode, wherein a select pulse applied to the select-electrode group is synchronized with a data-pulse sequence applied to the data-electrode group by shifting them a half line (H/2) relative to each other so that the select pulse and the data pulse have opposite polarity in relation to each other.

A driving method of a liquid crystal device in accordance with a third aspect of the present invention comprises a first substrate provided with a unidirectionally aligned data-electrode group and a second substrate provided with a select-electrode group aligned perpendicularly to the data electrode, wherein a select pulse is applied to the select-electrode group while a data pulse, in which the time and/or the voltage is determined so as to offset the effects of the reversed electric field generated during switching of the liquid crystal, is applied to the data-electrode group.

A driving method of a liquid crystal device in accordance with a fourth aspect of the present invention comprises a first substrate provided with a unidirectionally aligned data-electrode group and a second substrate provided with a select-electrode group aligned perpendicularly to the data electrode, wherein a select pulse applied to the select-electrode group is synchronized with a data-pulse sequence applied to the data-electrode group by shifting them a half line (H/2) relative to each other so that the select pulse and the data pulse have opposite polarity in relation to each other, and a select pulse is applied to the select-electrode group while a data pulse, in which the time and/or the voltage is determined so as to offset the effects of the reversed electric field generated during switching of the liquid crystal, is applied to the data-electrode group.

DESCRIPTION OF THE PREFERRED EMBODIMENTS

Figure 1:
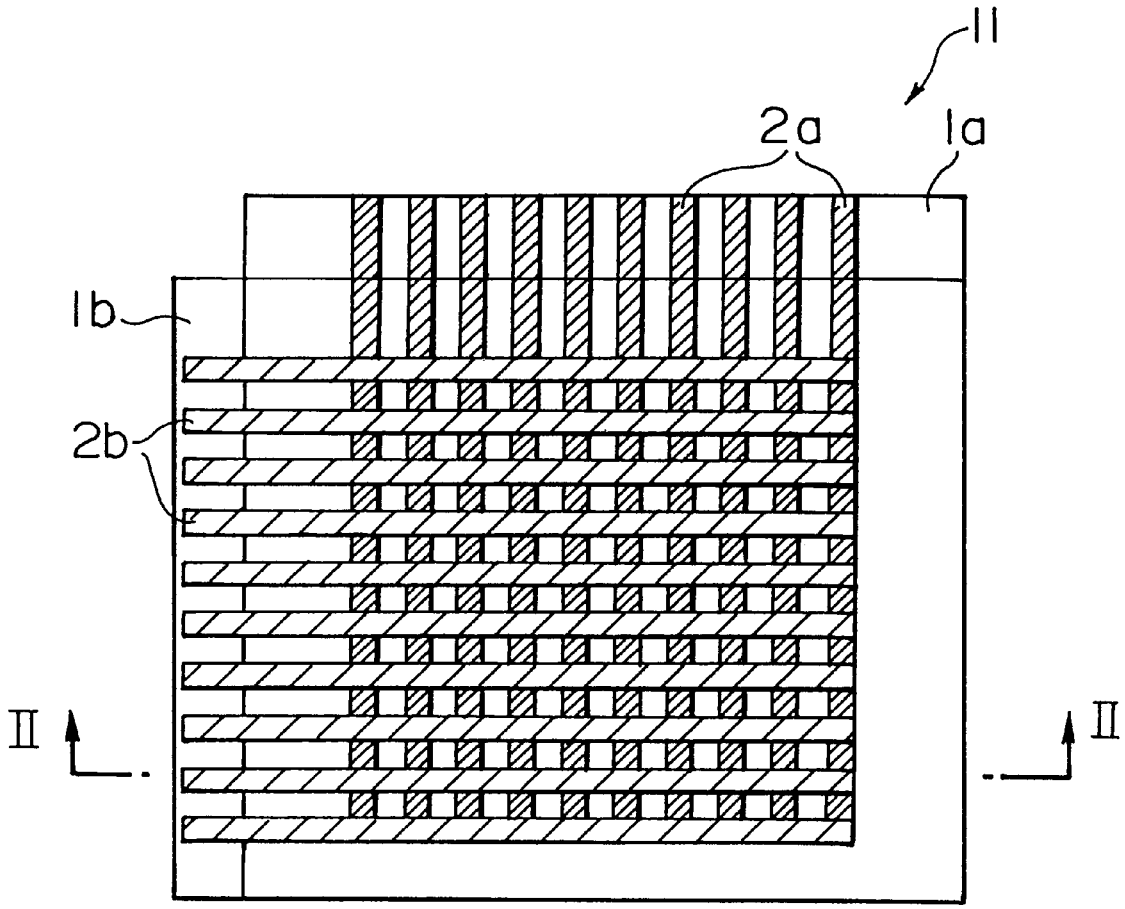
FIG. 1 is a schematic plan view of a conventional liquid crystal display device at a select electrode side.

In a first embodiment of the present invention, a driving method of a liquid crystal device comprises a first substrate provided with a unidirectionally aligned data-electrode group and a second substrate provided with a select-electrode group aligned perpendicularly to the data electrode, wherein after a select pulse is applied to the select electrodes, a pause corresponding to at least one line is provided before a data-pulse sequence is applied to the data-electrode group.

In the driving method in the first embodiment, since a pause corresponding to one line (1H) is provided between the current and next data lines, the shift of the transmittance of a pixel having an adjacent black or white pixel decreases. It is considered that the memorized spontaneous polarization is relaxed and the reversed electric field decreases while a data-pulse sequence and thus a bias pulse are not applied for a time period corresponding to one line. The effects of the next line can be satisfactorily reduced without modification of liquid crystal materials by changing data and select pulse sequences.

It is preferable to use a driving waveform in which a data pulse is not applied for a time corresponding to 1 to 2 lines in the first embodiment. A bipolar pulse is practically applied as a data pulse corresponding to 1 line.

In a second embodiment of the pre sent invention, a driving method of a liquid crystal device comprises a first substrate provided with a unidirectionally align ed data-electrode group and a second substrate provided with a select-electrode group aligned perpendicularly to the data electrode, wherein a select pulse applied to the select-electrode group is synchronized with a data-pulse sequence applied to the data-electrode group by shifting them a half line (H/2) relative to each other so that the select pulse and the data pulse have opposite polarity in relation to each other.

In the driving method in accordance with the second embodiment, a bipolar data-pulse sequence is practically applied by shifting the select pulse and the data pulse by a half line (H/2) in relating to each other, and a pulse of the current pixel is always applied for a first H/2 time period of the next line which significantly affects the change in transmittance due to a bias voltage. The transmittance is therefore uniquely determined without being affected by the reversed electric field. Further, the data-pulse sequence of the current pixel is applied after the select pulse is applied, and deterioration of image quality, e.g. pixel defects, is avoidable.

In a third embodiment of the present invention a driving method of a liquid crystal device comprises a first substrate provided with a unidirectionally aligned data-electrode group and a second substrate provided with a select-electrode group aligned perpendicularly to the data electrode, wherein a select pulse is applied to the select-electrode group while a data-pulse sequence, in which the time and/or the voltage is determined so as to offset the effects of the reversed electric field generated during switching of the liquid crystal, is applied to the data-electrode group.

In the third embodiment, a data-pulse sequence having a waveform which offsets the reversed electric field generated during switching by means of the select pulse is applied. A change in bias voltage of the next line due to superimposition of the reversed electric field can therefore be significantly decreased or eliminated when a data pulse is applied.

It is preferable to use a data-pulse sequence having opposite polarity and a larger pulse width than that of the select pulse in the third embodiment.

In a fourth embodiment in accordance with the present invention, a driving method of a liquid crystal device in accordance with a fourth aspect of the present invention comprises a first substrate provided with a unidirectionally aligned data-electrode group and a second substrate provided with a select-electrode group aligned perpendicularly to the data electrode, wherein a select pulse applied to the select-electrode group is synchronized with a data-pulse sequence applied to the data-electrode group by shifting them a half line (H/2) relative to each other so that the select pulse and the data pulse have opposite polarity in relation to each other, and a select pulse is applied to the select-electrode group while a data pulse, in which the time and/or the voltage is determined so as to offset the effects of the reversed electric field generated during switching of the liquid crystal, is applied to the data-electrode group.

In the fourth embodiment, the advantages in the second and third embodiments can be simultaneously achieved.

It is preferable to use a data-pulse sequence having opposite polarity and a larger pulse width than that of the select pulse in the fourth embodiment.

In the above-mentioned embodiments, it is preferable to drive a passive-matrix ferroelectric liquid crystal device in which regions having different threshold voltages for switching are finely distributed for gradation display. It is preferable that fine particles be added to the ferroelectric liquid crystal in order to form regions having different threshold voltages.

The present invention will now be described in detail with reference to the drawings.

First Embodiment

Figure 9A:
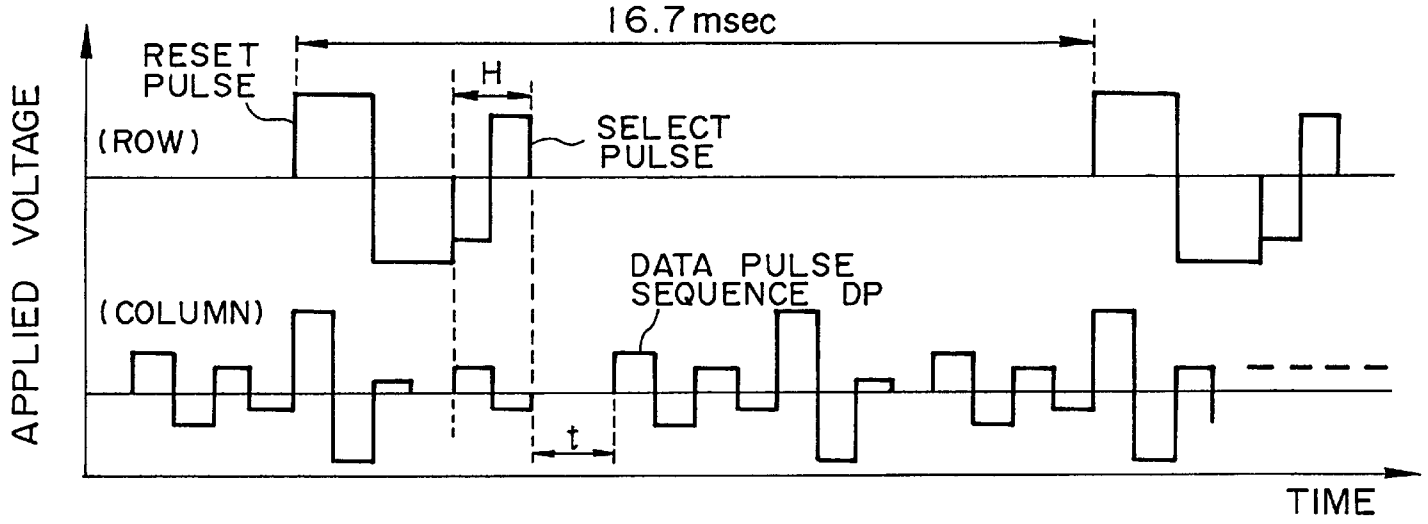
FIG. 9A is a schematic graph of a driving waveform applied to a liquid crystal display device in accordance with an embodiment of the present invention.
Figure 10:
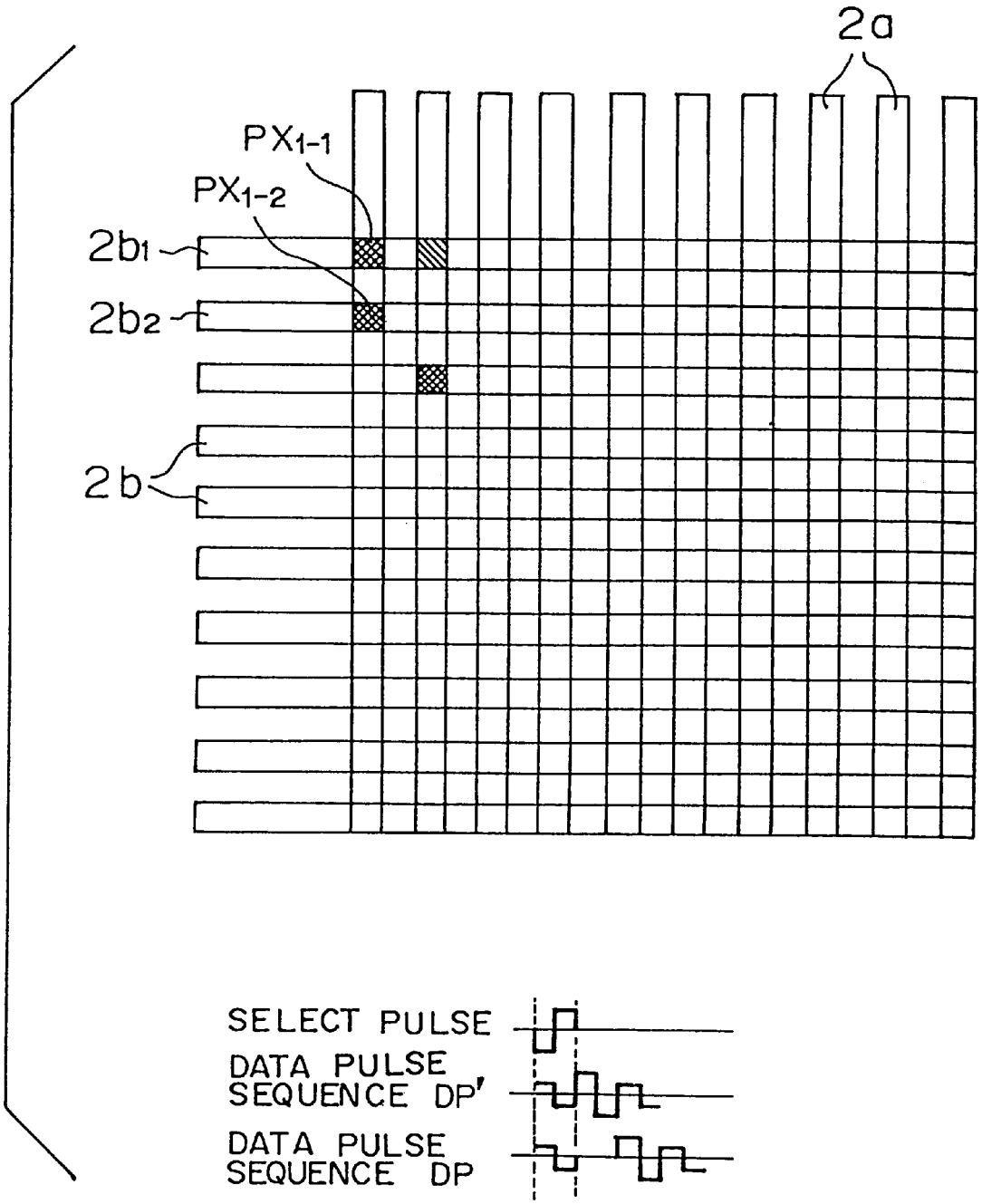
FIG. 10 is a schematic plan view illustrating a driving state of a liquid crystal display device.
Figure 11:
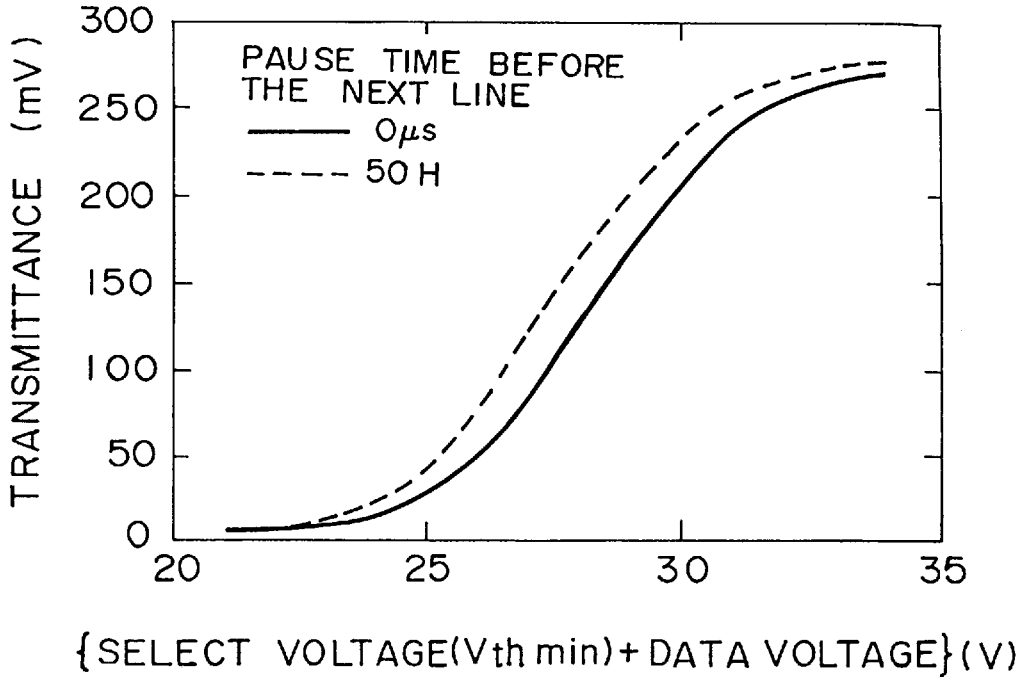
FIG. 11 is a graph illustrating the change in applied voltage vs. transmittance curve when the length of the pause time before the next line is varied in a liquid crystal display device.
Figure 12:
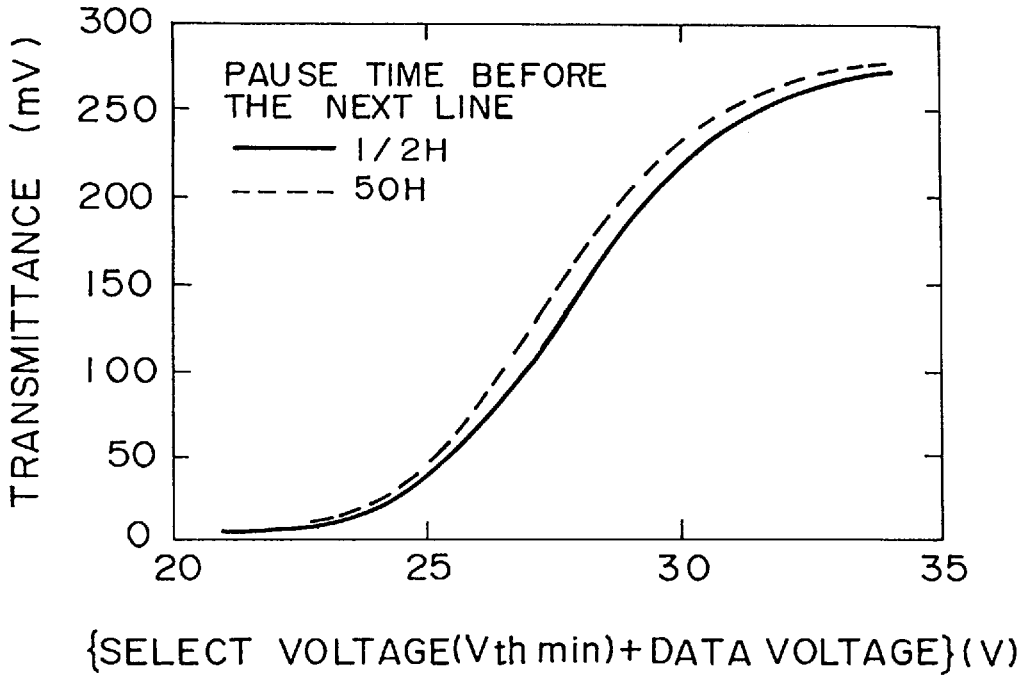
FIG. 12 is a graph illustrating the change in applied voltage vs. transmittance curve when the length of the pause time before the next line is varied in a liquid crystal display device.
Figure 13:
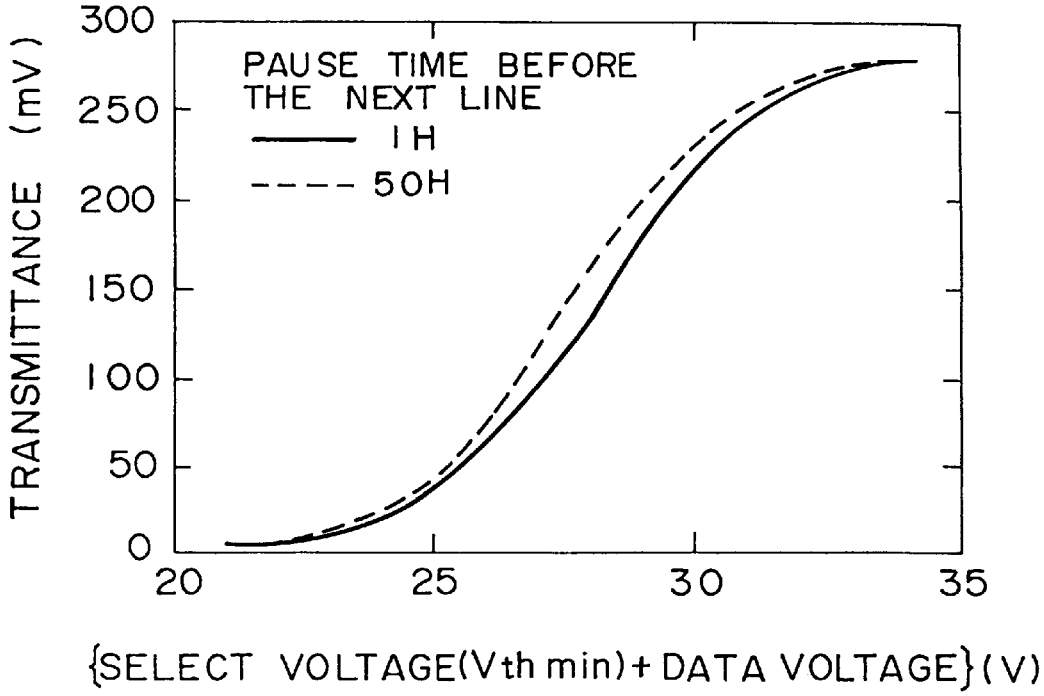
FIG. 13 is a graph illustrating the change in applied voltage vs. transmittance curve when the length of the pause time before the next line is varied in a liquid crystal display device.
Figure 14:
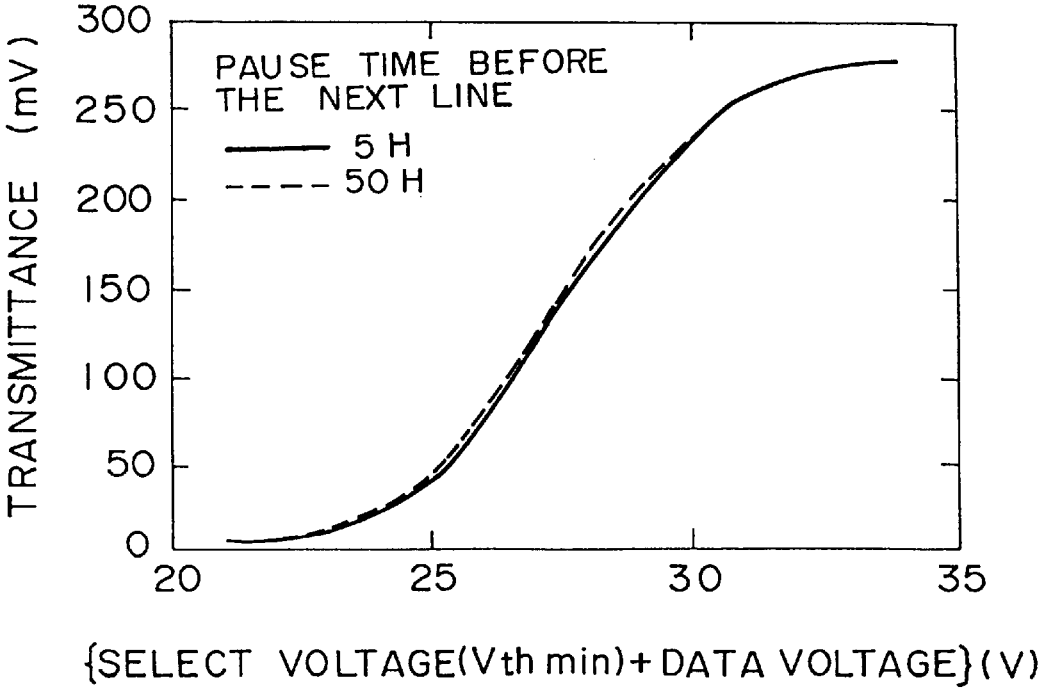
FIG. 14 is a graph illustrating the change in applied voltage vs. transmittance curve when the length of the pause time before the next line is varied in a liquid crystal display device.
Figure 15:
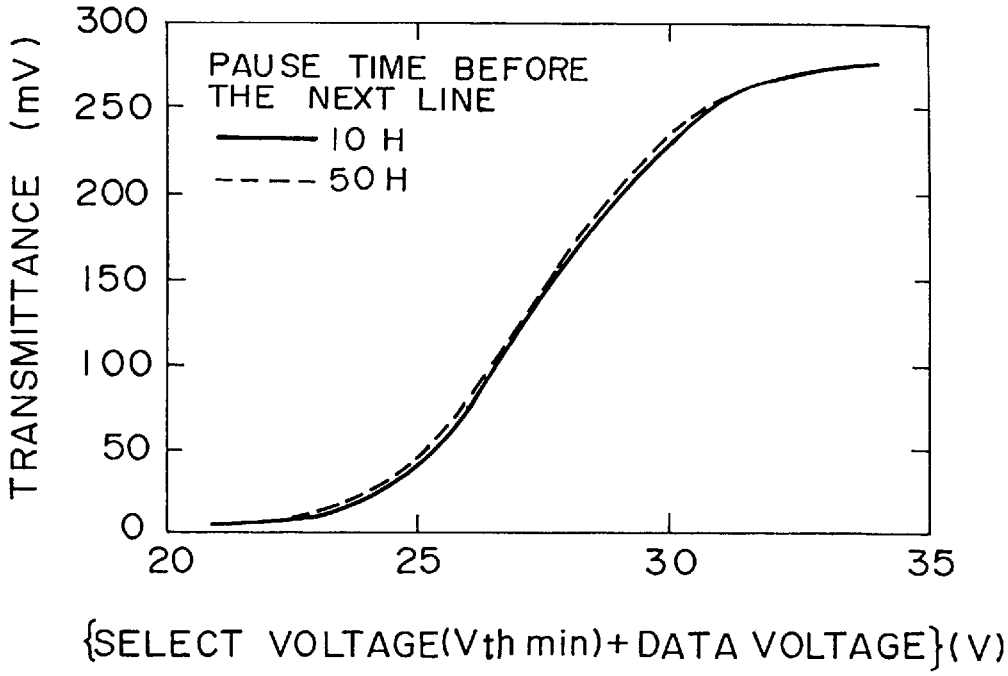
FIG. 15 is a graph illustrating the change in applied voltage vs. transmittance curve when the length of the pause time before the next line is varied in a liquid crystal display device.
Figure 16:
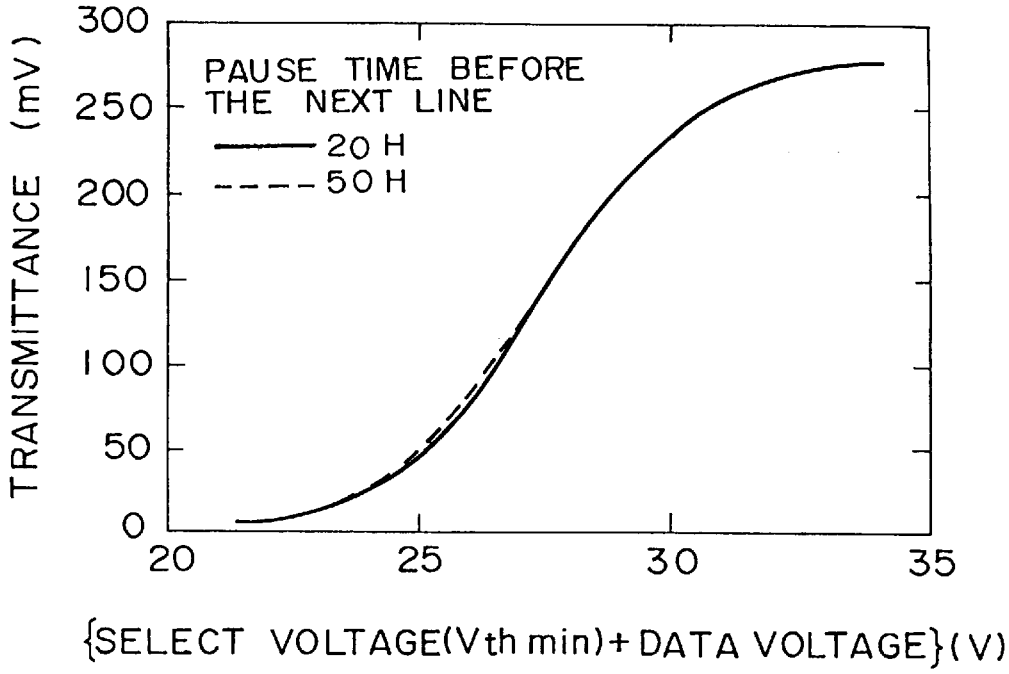
FIG. 16 is a graph illustrating the change in applied voltage vs. transmittance curve when the length of the pause time before the next line is varied in a liquid crystal display device.

A ferroelectric liquid crystal display device in accordance with the first embodiment will be described with reference to FIG. 9 to 11.

A tantalum boat (made by Japan Vacs Metal Co., Ltd.) containing SiO powder of purity of 99.99% (made by Furuuchi Chemical Corporation) was heated with a resistant heater and sputtered by a vacuum deposition process to form a rhombic SiO film having a thickness of 50 nm on a transparent ITO substrate at 100° C. having a thickness of 40 nm and a surface resistivity of 100 $\Omega/cm_2$, so that the angle between the normal line of the substrate and the vertical line from the deposition source was 85 degrees. After deposition, the deposited film was baked in the atmosphere at 200° C. for 1 hour in order to improve orientation. Two substrates were prepared in such a manner.

Figure 2:
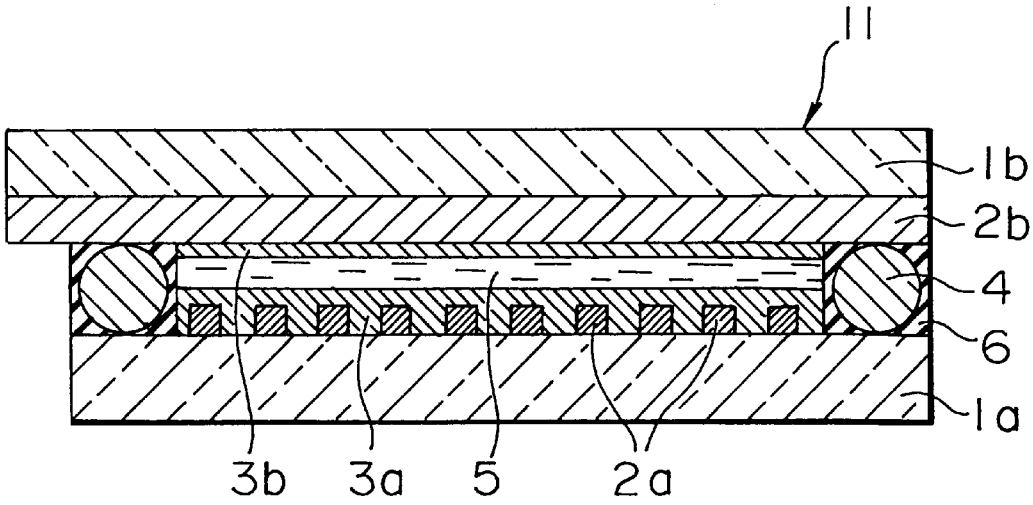
FIG. 2 is a cross-sectional view taken along sectional line II—II in FIG. 1.
Figure 3:
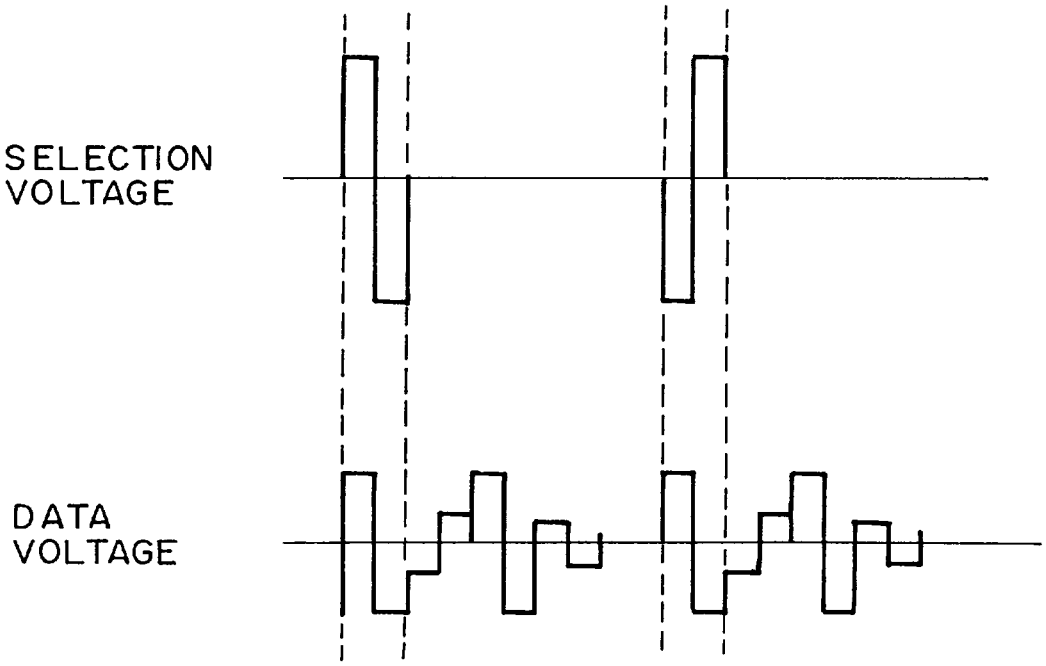
FIG. 3 is a schematic graph of a select pulse and a data-pulse sequence used in a conventional driving system of a liquid crystal display device.
Figure 4:
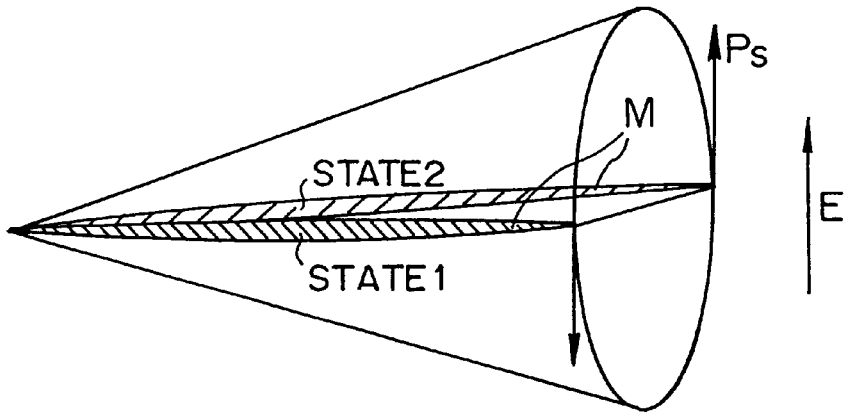
FIG. 4 is a schematic graph illustrating a model of a ferroelectric liquid crystal.

The two substrates were assembled with spherical spacers having a diameter of 1.6 $\mu$m (made by Catalysts & Chemical Industries Co., Ltd.) and a UV curable bonding agent (Photorec made by Sekisui Chemical Co., Ltd.) to form an empty liquid crystal cell so that the orientation directions of the two rhombic SiO-deposited films are antiparallel each other. The cell gap was filled with a mixture of a ferroelectric liquid crystal (YS-C152 made by Chisso Corporation) and 2 percent by weight of titanium oxide fine particles (IT-S made by Idemitsu Kosan Co., Ltd.) to prepare a ferroelectric liquid crystal (FLC) display device as shown in FIGS. 1 and 2. The display device has the same configuration as that in the prior invention, and a further description is omitted.

A change in transmittances at different applied voltages was measured using the liquid crystal display device (liquid crystal panel). A driving waveform as shown in FIG. 9A was applied through crossed Nicols, and a select pulse was applied. After the pause time t, a data pulse for the next line was applied, that is, a pause time t corresponding to 1 line, and preferably 1 to 2 lines was provided between the select pulse and the data-pulse sequence DP. The transmittances were observed with different pause times t. A driven waveform, in which the data-pulse sequence DP' is applied immediately after the application of the select pulse, is shown for comparison in FIG. 9B.

When the pause time corresponding to at least one line (1H) is provided before the application of the data-pulse sequence DP for the next line, the change in transmittances when the following pixels are, for example, black and white decreases with the pause time as shown in FIGS. 11 to 16.

With this it is considered that the memorized spontaneous polarization is relaxed and the reversed electric field decreases, since the data-pulse sequence and thus a bias pulse are not applied during the pause time for the next line. Effects due to the next line can therefore be satisfactorily offset without modification in liquid crystal materials.

As a result, a complete analog gradation can be achieved by using a driving waveform to form an adequate gradation in a liquid crystal device containing fine particles. FIG. 10 is a schematic view illustrating a state in which a grey level can be displayed on the current pixel $Px_{2-1}$ when a data-pulse sequence DP corresponding to a white level is applied after a pause corresponding to one line. In contrast, when a data-pulse sequence DP' is applied for the next line, the current pixel $Px_{2-1}$ changes to the black level not to the gray level.

Figure 17:
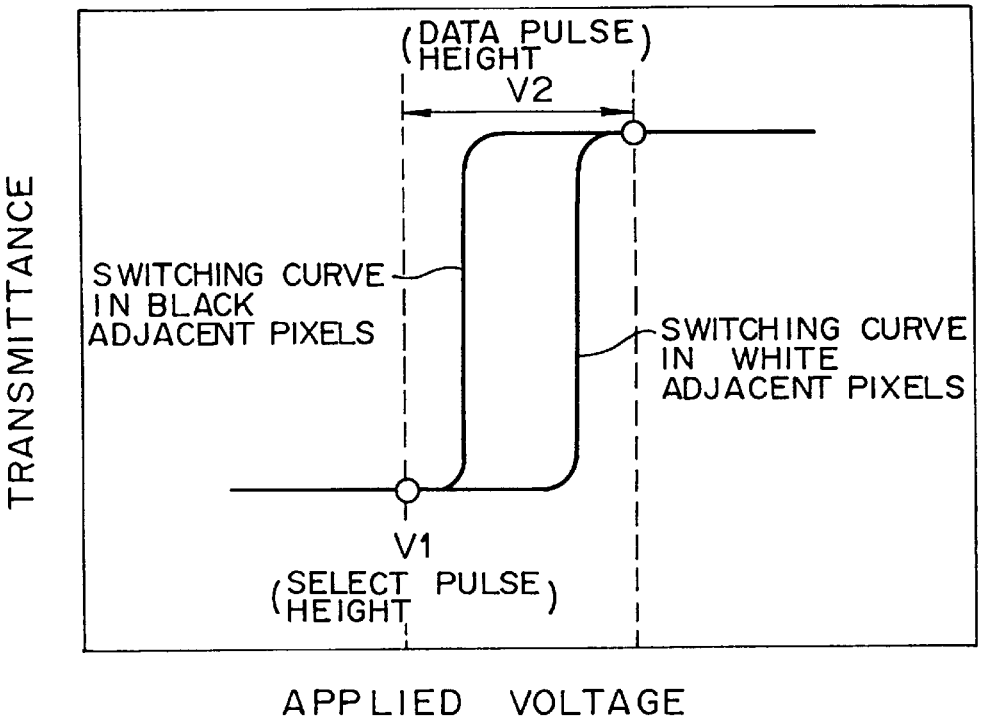
FIG. 17 is a graph illustrating the select voltage height and the data voltage height in a driven liquid crystal display device.
Figure 18:
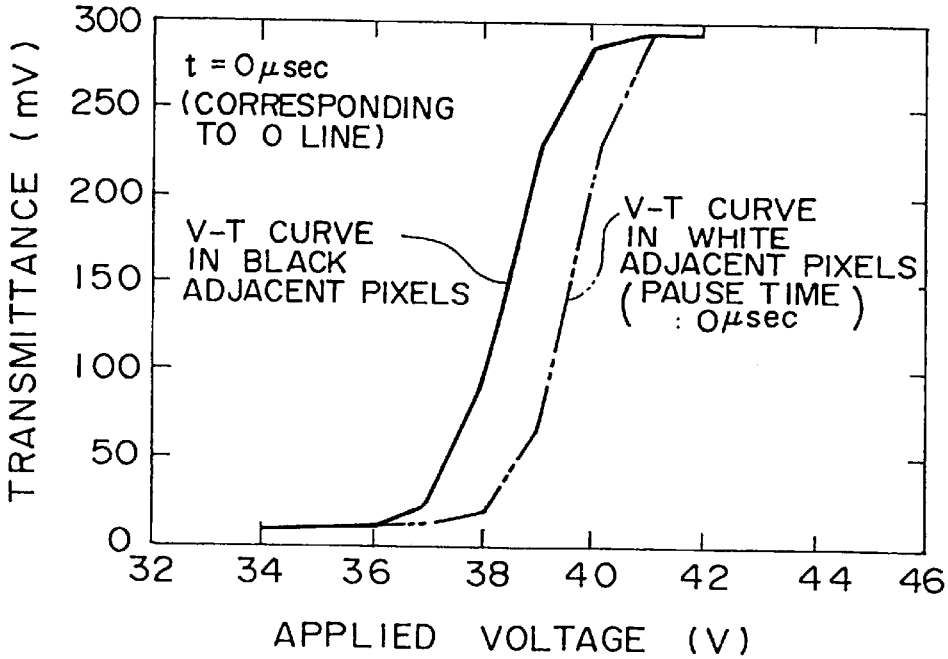
FIG. 18 is a graph including a V-T curve when the adjacent pixels are black and a V-T curve when the adjacent pixels are white in a liquid crystal display device, in which at the length of the pause time for the next line is 0 μsec.
Figure 19:
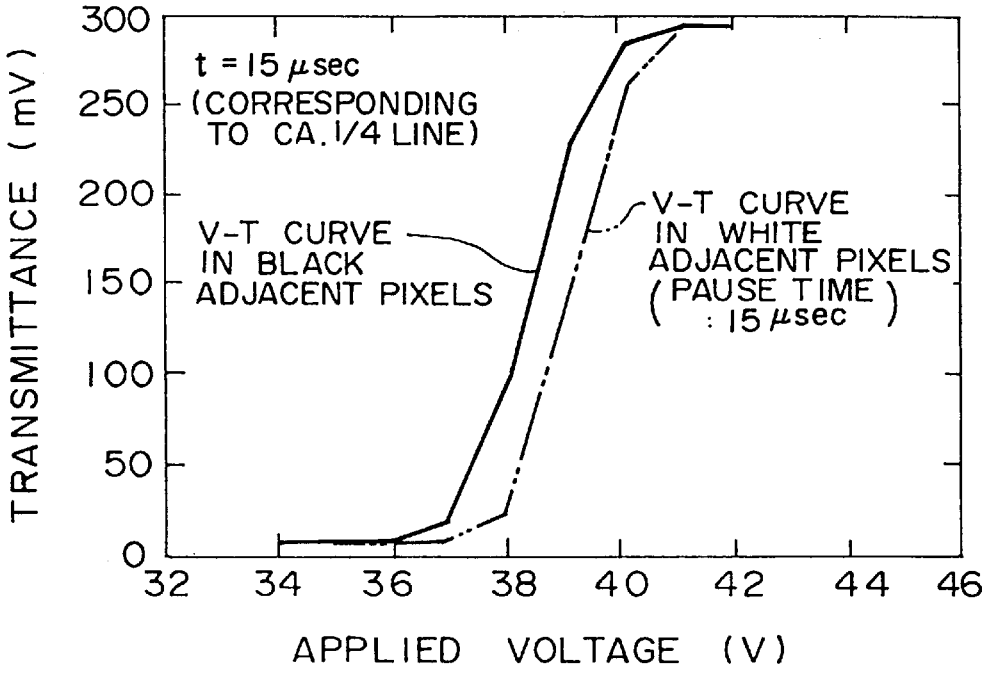
FIG. 19 is a graph including a V-T curve when the adjacent pixels are black and a V-T curve when the adjacent pixels are white in a liquid crystal display device, in which at the length of the pause time for the next line is 15 μsec.
Figure 20:
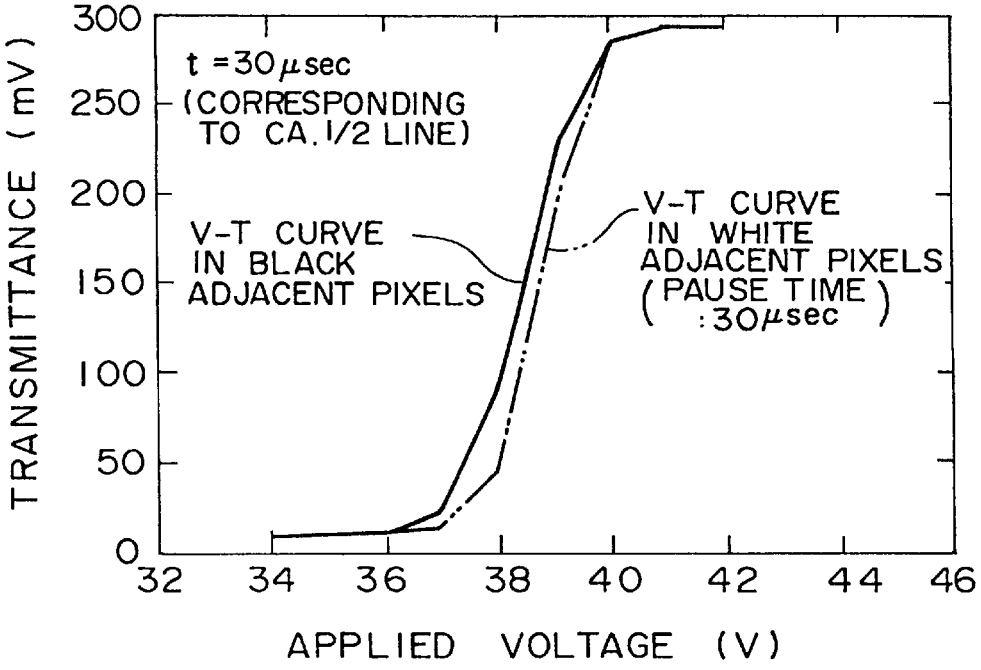
FIG. 20 is a graph including a V-T curve when the adjacent pixels are black and a V-T curve when the adjacent pixels are white in a liquid crystal display device, in which at the length of the pause time for the next line is 30 μsec.
Figure 21:
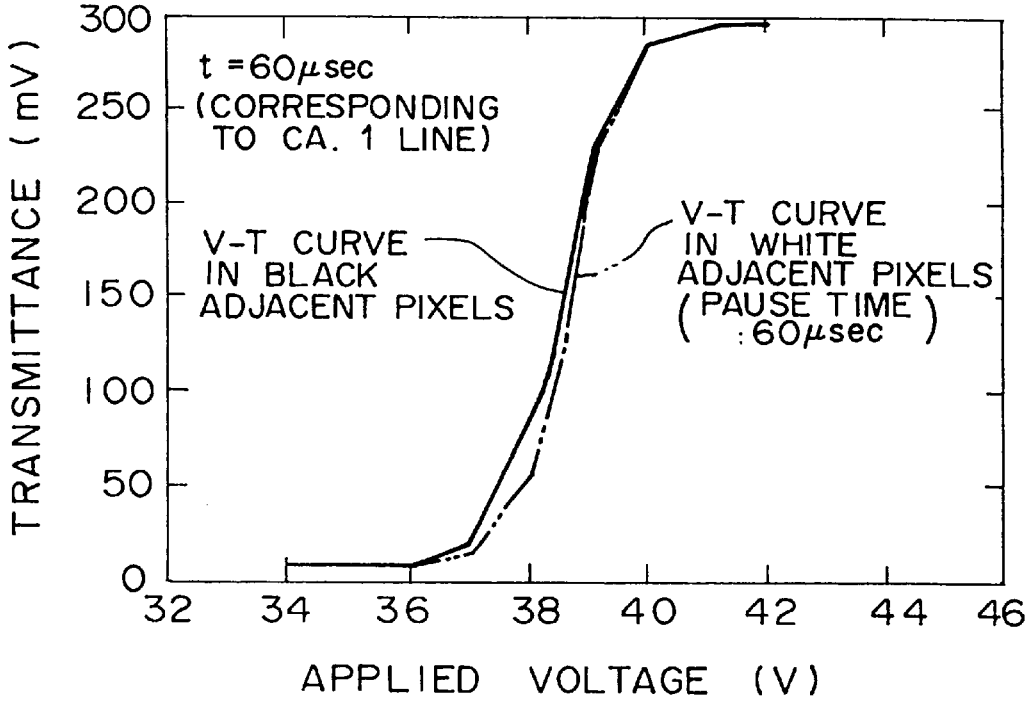
FIG. 21 is a graph including a V-T curve when the adjacent pixels are black and a V-T curve when the adjacent pixels are white in a liquid crystal display device, in which at the length of the pause time for the next line is 60 μsec.
Figure 22:
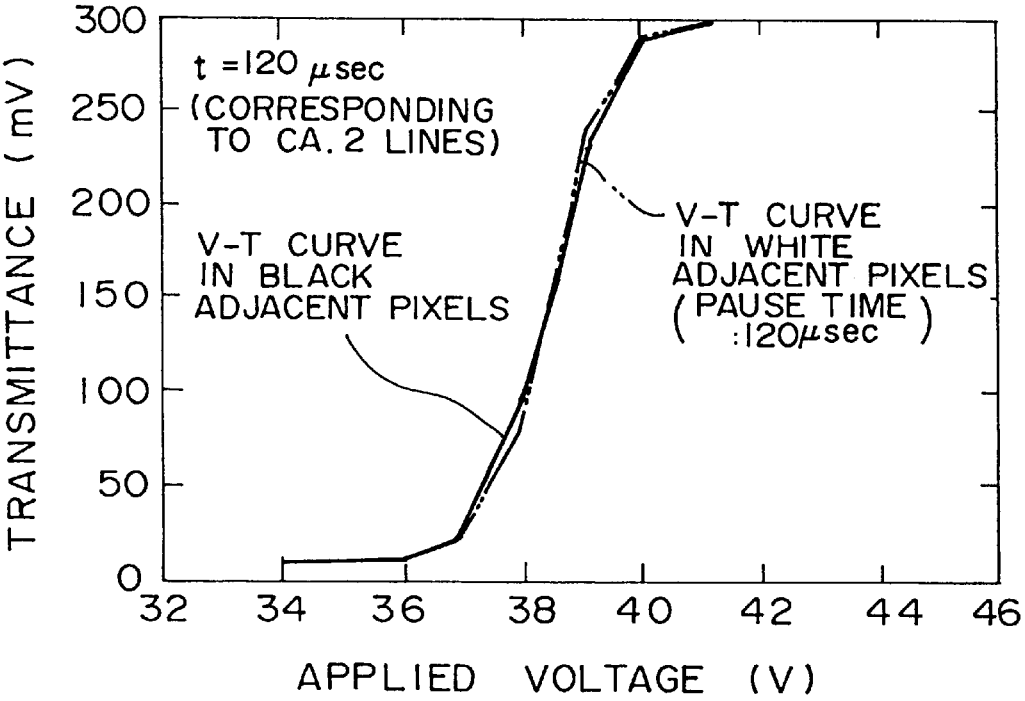
FIG. 22 is a graph including a V-T curve when the adjacent pixels are black and a V-T curve when the adjacent pixels are white in a liquid crystal display device, in which at the length of the pause time for the next line is 120 μsec.

This waveform is, of course, very effective to display a binary image composed of white and black with an ferroelectric liquid crystal, since the maximum voltage of the data-pulse sequence can be decreased as shown in FIG. 17.

Figure 9B:
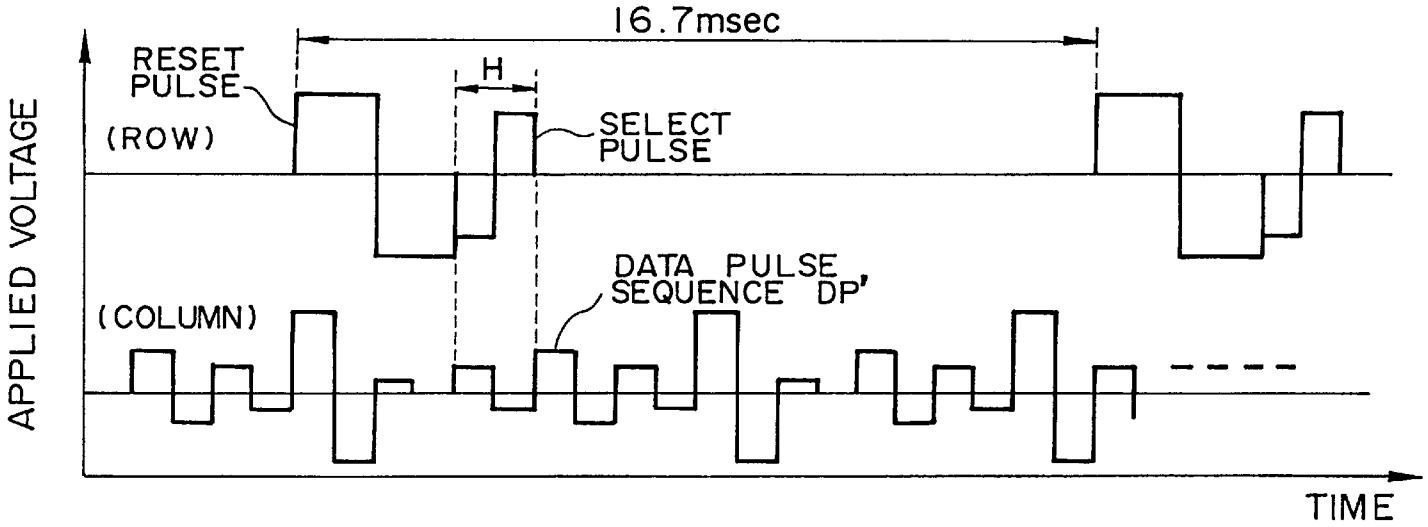
FIG. 9B is a schematic graph of a driving waveform applied to a liquid crystal display device for comparison.

Consequently, the switching curve significantly shifts due to the effects of the reversed electric field on the current pixel caused by changes from white to black and from black to white when a data-pulse sequence for the next line is applied immediately after switching by a select pulse as shown in FIG. 9B. In contrast, the reversed electric field can be decreased in the driving waveform due to a pause time of at least one line before the data-pulse sequence DP for the next line. Display based on the analog gradation can therefore be achieved according to a constant switching curve. Further, a constant switching curve can be achieved in the display of a binary image with a decreased data pulse height (a large data pulse height varies the switching curve).

FIGS. 18 to 22 are graphs illustrating the correlation between the transmittance and the applied voltage in different pause times using the waveform shown in FIG. 9A. These results demonstrate that when the pause time between the applied select pulse and the next line is extended to at least on e line, i.e., approximately 60$\mu$ seconds, a shift in th e transmittance due to the bias voltage decreases to an extent that the image quality is not affected, and when the pause time is approximately 120$\mu$ seconds (corresponding two lines), the shift is not observed.

These results are summarized in Table 1. The results in Table 1 demonstrate that the shift of the V-T curve is ignored at the pause time t corresponding to 2 lines, i.e., 120$\mu$ seconds. It is preferable that the pause time t be in a range of 1 line to 2 lines or 60$\mu$ seconds to 120$\mu$ seconds in view of image quality, i.e., reduction of horizontal lines).

TABLE 1

| Pause time between select pulse and the next line | Shift of V-T curve at 50% transmittance |
|---|---|
| 0 $\mu$sec. | 1.11 V |
| 15 $\mu$sec. | 758 mV |
| 30 $\mu$sec. | 316 mV |

TABLE 1-continued

| Pause time between select pulse and the next line | Shift of V-T curve at 50% transmittance |
|---|---|
| 60 $\mu$sec. | 126 mV |
| 120 $\mu$sec. | 0 V |

In the ferroelectric liquid crystal in this embodiment (which will also be used in the following embodiments), a state that regions having different threshold voltages are finely distributed in a pixel is formed by the addition of the above-mentioned fine particles. When the transmittance due to reverse domains (for example, black domains in white domains or vice versa) is 25%, at least 300 and preferably at least 600 domains (microdomains) having a diameter of 1 $\mu$m or more are present in a visual field of 1 $mm^2$, and the threshold voltages in the reverse domains are 1 V or more, and preferably 2 V or more within a transmittance range of 10 to 90%.

Figure 5:
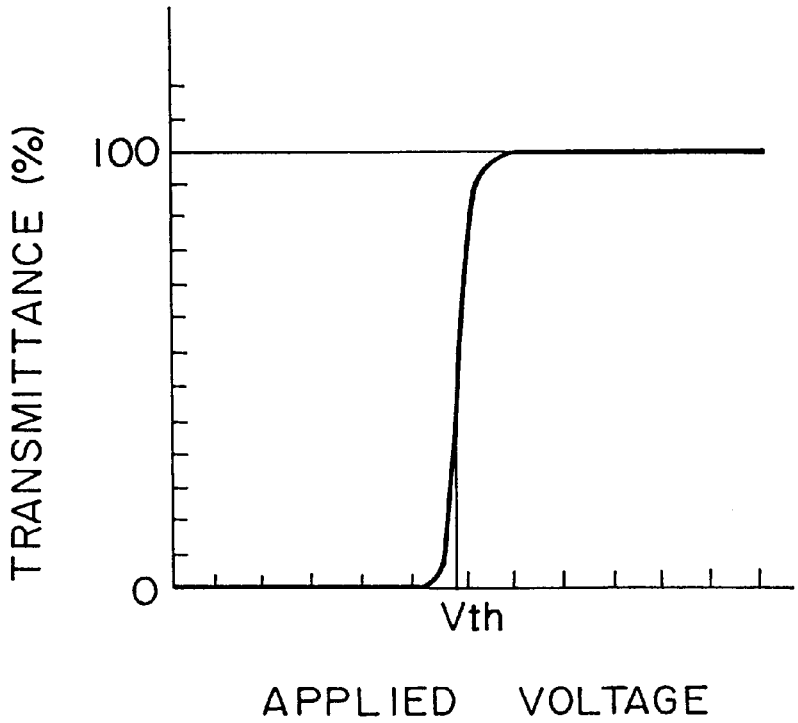
FIG. 5 is a graph of a characteristic curve illustrating the correlation between applied voltage and transmittance in a ferroelectric liquid crystal display device.
Figure 6:
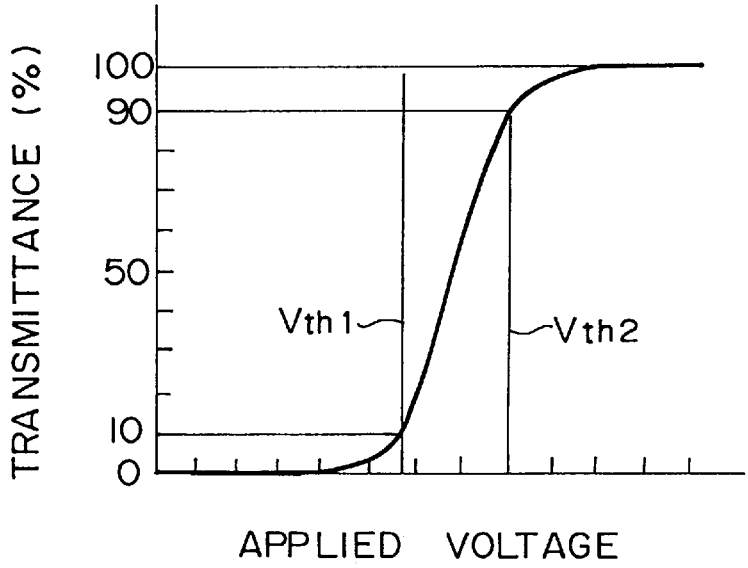
FIG. 6 is a graph of a characteristic curve illustrating the correlation between applied voltage and transmittance in a ferroelectric liquid crystal display device containing fine particles.
Figure 7:
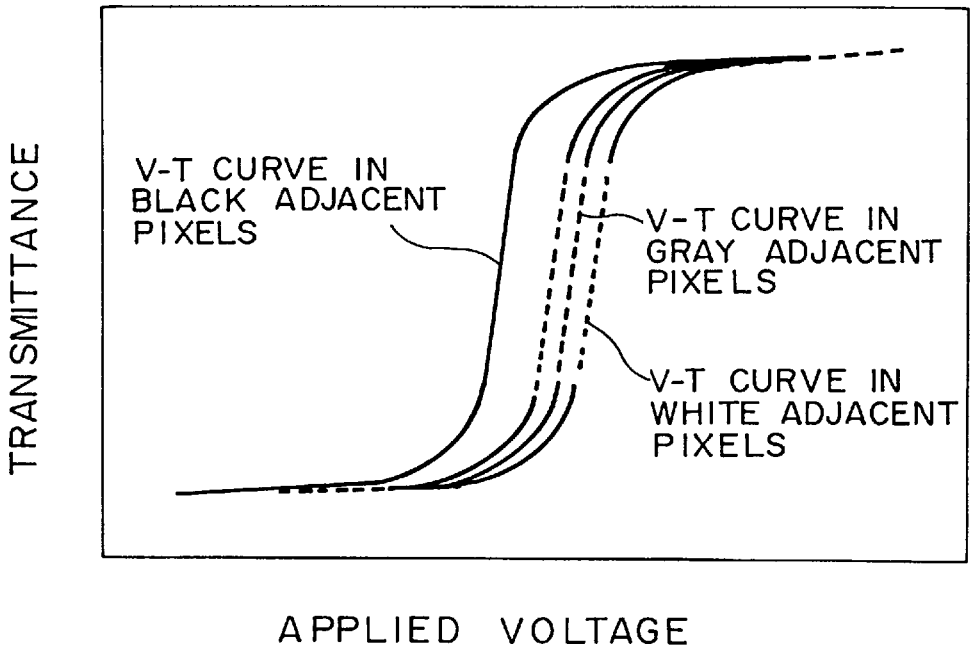
FIG. 7 is a graph illustrating the change in applied voltage vs. transmittance curve due to bias voltage.
Figure 8:
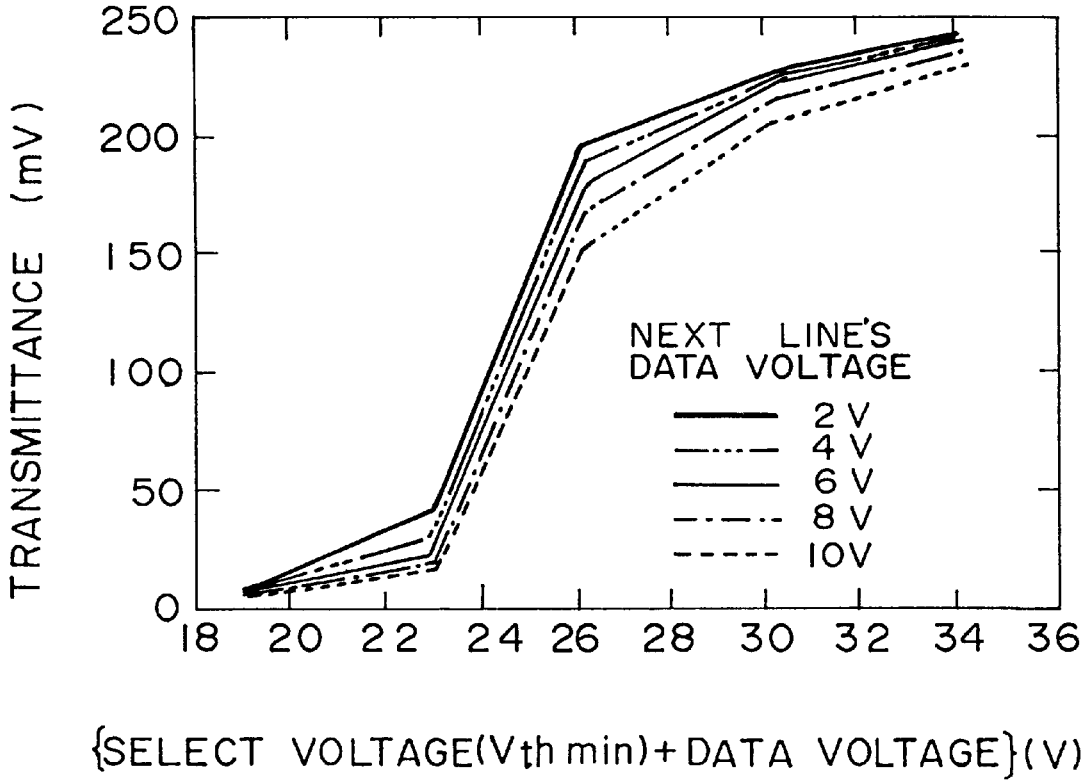
FIG. 8 is a graph illustrating the change in applied voltage vs. transmittance curve in a current pixel when the colors of the adjacent pixels are varied in a liquid crystal display device.

As shown in FIG. 6, the liquid crystal does not have a steep change in the transmittance with the applied voltage shown in FIG. 5, but has a gentle change. This phenomenon is explained that the transmittances of microdomains having different threshold voltages in a pixel change in response to their respective threshold voltages. Since bistable liquid crystal molecules in one domain have a memory effect and one pixel is composed of microdomains having different threshold voltages, continuous gradation display is achieved in the pixel. In FIG. 6, if a threshold voltage at a 10% transmittance is $V_{th1}$ and a threshold voltage at a 90% transmittance is $V_{th2}$, the change width ($\Delta V_{th}=V_{th2}-V_{th1}$) is 1 V or more.

Figure 23A:
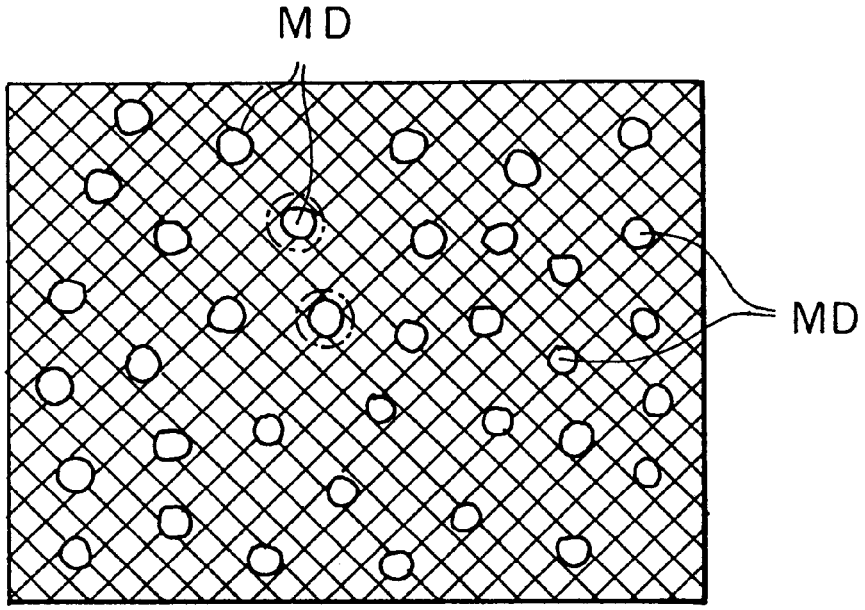
FIGS. 23A and 23B are schematic views of domains formed in driven liquid crystal display devices in accordance with the present invention and for comparison, respectively.

As shown in FIG. 23A, at least 300 microdomains MD having a diameter of 1 $\mu$m or more are present in a visual field of 1 $mm^2$ at a transmittance of 25%, and the threshold voltages in the reverse domains are 1 V or more. A screen having intermediate gradations (transmittances) is achieved by fine light transmittable regions composed of microdomains. Hereinafter such a microdomain structure will be referred to as a starlight texture.

Figure 23B:
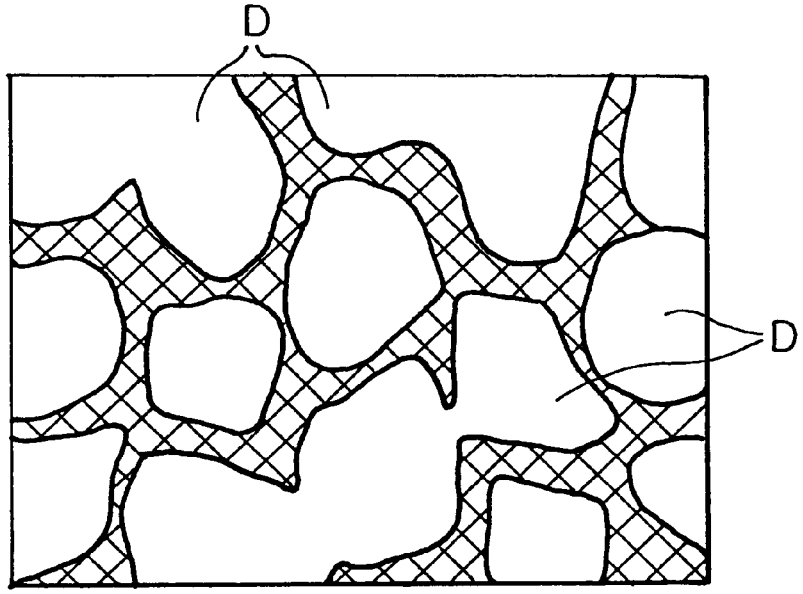

The light transmittable regions due to microdomains MD can be extended to increase the transmittance or contracted to decrease the transmittance in the starlight texture in response to the applied voltages as shown in an alternate long and short dash line, or in other words, the transmittance can be changed in response to the applied voltages. In contrast, each of devices shown in FIGS. 1 to 5 has an extremely low threshold voltage width as shown in FIG. 23B, and therefore light transmittable regions D abruptly increase or disappear in response to the applied voltage, resulting in difficult gradation.

Figure 24:
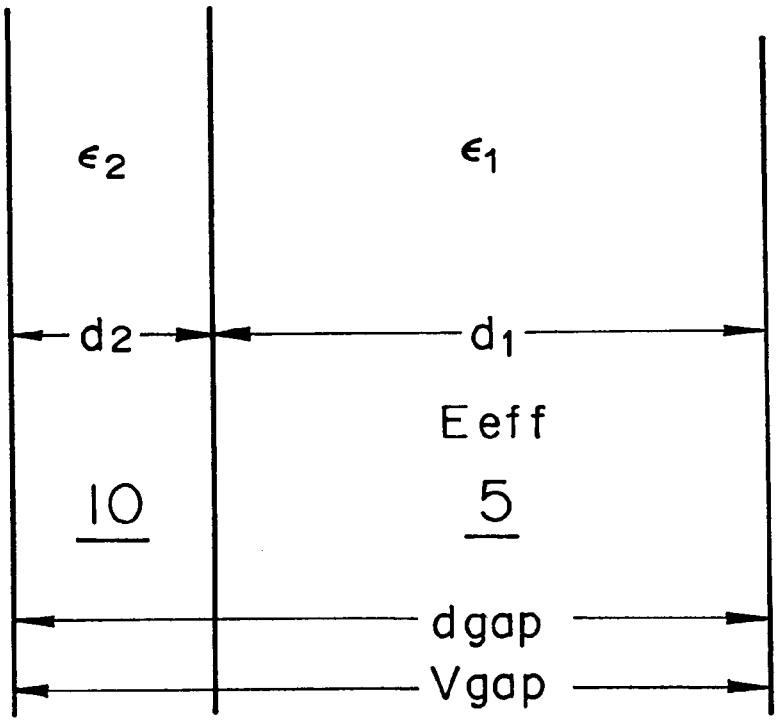
FIG. 24 is a schematic view illustrating the change in threshold voltage in a liquid crystal display device.

In the production of the liquid crystal device, fine particles or ultrafine particles may be dispersed into the liquid crystal molecules in the liquid crystal cell in order to form microdomains. The change in the threshold voltage due to fine particles will be explained with reference to FIG. 24. An electric field $E_{eff}$ applied to fine particles is expressed by the following equation (1):

$$E_{eff}=\{\epsilon_2/\{\epsilon_1 d_2+\epsilon_2 d_1)\}\times V_{gap} \quad (1)$$

wherein $d_2$ and $\epsilon_2$ represent the particle size and dielectric constant of fine particles 10, respectively, and $d_1$ and $\epsilon_1$ represent the thickness and dielectric constant of the liquid crystal 5 other than the fine particles 10.

The addition of fine particles having a lower dielectric constant than the liquid crystal ($\epsilon_2<\epsilon_2$) therefore gives $$E_{eff}<E_{gap}$$

because fine particles $d_2$ smaller than the total thickness $d_{gap}$ ($=d_1+d_2$) of the liquid crystal layer are added. Thus, a smaller electric field $E_{eff}$ is applied to the liquid crystal compared to that ($E_{gap}$) of the liquid crystal not containing fine particles.

In contrast, the addition of fine particles having a higher dielectric constant than the liquid crystal ($\epsilon_2>\epsilon_2$) gives $$E_{eff}>E_{gap}$$

and a larger electric field $E_{eff}$ is applied to the liquid crystal compared to that ($E_{gap}$) of the liquid crystal not containing fine particles.

These results are summarized as follows:

$$\text{If } \epsilon_1>\epsilon_2,\ E_{eff}<\{V_{gap}/(d_1+d_2)\}=V_{gap}/d_{gap}=E_{gap}$$

$$\text{If } \epsilon_1=\epsilon_2,\ E_{eff}=E_{gap}$$

$$\text{If } \epsilon_1<\epsilon_2,\ E_{eff}>E_{gap}$$

In all the cases, the effective electric field $E_{eff}$ applied to the liquid crystal varies by the addition of fine particles and regions containing fine particles have different effective electric fields from other regions. As a result, when an electric field $E_{gap}$ is applied to the liquid crystal, a starlight texture can be achieved due to reverse domains and other domains, as shown in FIG. 23A.

As described above, the starlight texture is suitable for continuous gradation, and various transmittance levels (at least two gradation levels) can be achieved by the combination of the control of the applied voltage (magnitude and pulse width) and the addition of fine particles. If fine particles of 0.3 to 2 $\mu$m are merely added in a microgap of approximately 2 $\mu$m, desired display performance cannot be achieved. Uneven color distribution will occur at fine particle regions even if the gap is not a microgap. The starlight texture does not form such phenomena and can achieve desired performance.

Fine particles, which generate an effective electric field distribution in the liquid crystal 5 between two opposing transparent electrodes 2*a* and 2*b* shown in FIGS. 1 and 2, can be added to the liquid crystal in the present invention. For example, fine particles composed of a plurality of materials having different dielectric constants may be used. Fine particles having different dielectric constants form a dielectric constant distribution in one pixel.

As a result, the effective electric field applied to the liquid crystal in each pixel has a distribution when a uniform external electric field is applied between the transparent electrodes 2*a* and 2*b* of each pixel, the width of the threshold voltage for switching bistable states of the liquid crystal (and in particular the ferroelectric liquid crystal) can be expanded, and thus analog gradation display can be achieved in one pixel.

When fin e particles each having the same dielectric constant are used, the fine particles are composed of particles having different sizes in order to generate a thickness distribution in the liquid crystal layer. The effective electric field applied to the liquid crystal in one pixel has an intensity distribution even when a uniform external electric field is applied between the transparent electrodes of the pixel, resulting in analog gradation in one pixel. It is preferable that the fine particles have a spread distribution in order to achieve excellent analog gradation.

It is preferable that the fine particles added to the liquid crystal in accordance with this embodiment have a surface pH of 2.0 or more in order to prevent protic deterioration of the liquid crystal.

The amount of the fine particles is appropriately determined in view of a desired analog gradation and the like. It is preferable that the fine particles be added to the liquid crystal in an amount of 0.1 to 50 percent by weight. An excessive amount of addition causes coagulation of fine particles to inhibit the formation of a starlight texture and the injection of the liquid crystal.

Usable fine particles may be composed of carbon black and/or titanium oxide. It is preferred that the carbon black be thermal furnace black made by a furnace process and the titanium oxide be amorphous titanium oxide. The thermal furnace black has a wide particle size distribution, whereas the amorphous titanium oxide has excellent surface characteristics and durability.

Usable fine particles preferably have sizes of one-half or less the gap of the liquid crystal cell, i.e., 0.4 $\mu$m or less, and in particular 0.1 $\mu$m or less in terms of primary fine particles which are not agglomerated. The preferable shape is a spherical shape in view of controlling the gradation. The gradation can be controlled by a particle size distribution. It is preferable that the standard deviation of the particle size distribution be 9.0 nm or less in order to moderate the change in the transmittance. The specific gravity of the fine particles preferably ranges from 0.1 to 10 times that of the liquid crystal in order to prevent sedimentation of the fine particles. The surfaces of the fine particles are preferably modified with silane coupling agents to improve dispersibility.

As described above, since the fine particles have extremely small sizes, the fine particles may be referred to as ultrafine particles.

In the present invention, the fine particles are preferably present in the liquid crystal between the opposing electrodes. The fine particles may also be present in or on the liquid crystal aligning film. The same liquid crystal configuration as in FIGS. 1 and 2 can be employed in this case. For example, a transparent glass plate may be used as a substrate, indium tin oxide (ITO) may be used as an electrode layer material, and a polyimide film and a rhombic SiO deposited film after rubbing treatment may be used as a liquid crystal alignment film. The driving system may be also the same as above; however a data-pulse sequence is always applied to the entire frame because a grey level in the starlight texture composed of microdomains is achieved by varying the voltage of the data pulse.

A ferroelectric liquid crystal usable in this embodiment is preferably a mixture of a chiral smectic C (SmC*) liquid crystal and a nonchiral smectic C (SmC) liquid crystal. Only one type among these or a mixture of a plurality types of liquid crystals may also be used.

Examples of chiral smectic C (SmC*) ferroelectric liquid crystals include known pyrimidine-, biphenyl-, phenylbenzoate-type chiral smectic C ferroelectric liquid crystals. These ferroelectric liquid crystals may give a chiral nematic phase or a smectic phase due to the change in temperature.

A typical example of usable nonchiral smectic C (SmC) liquid crystals is ZLI-2008-000 (melting point: −6° C., temperature range of the nematic phase: −20 to 64° C.) made by Merck & Co., Inc. Other known nonchiral smectic liquid crystals, for example, biphenyl-type, terphenyl-type, triscyclohexyl-type, cyclohexylphenyl-type, biphenylcyclohexane-type, cyclohexylethane-type, ester-type, prymidine-type, pyridazine-type, ethane-type, and dioxane-type can also be used.

Figure 25:
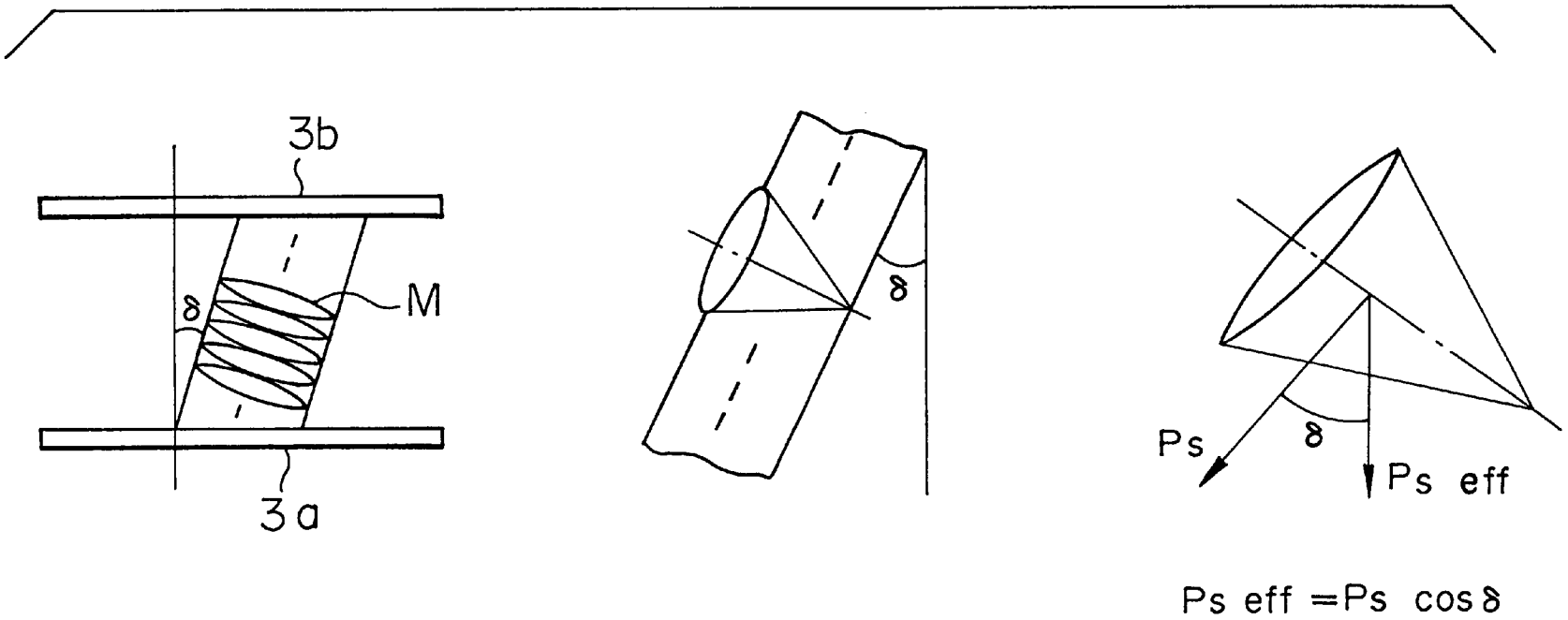
FIG. 25 is a schematic view illustrating the correlation between a tilt angle of ferroelectric liquid crystal layers and effective spontaneous polarization.

A tilt angle distribution of the liquid crystal can also permit gradation. The above-mentioned ultrafine particles spontaneously form a distribution of the tilt angle δ shown in FIG. 25 regardless of their characteristics, or in other words, a distribution of the spontaneous effective polarization $P_{seff}$ (a characteristic value which determined the threshold value of the ferroelectric liquid crystal). Many domains having various threshold values are present in one pixel. A nanometer order of ultrafine particles has a pinning effect which breaks off continuity of layers around the particles and prevents expansion of domains, whereas a submicron order of particles does not have a pinning effect or form a large defect adversely affecting the transmittance even if these have the pinning effect.

Second Embodiment

A ferroelectric liquid crystal display device in accordance with the second embodiment will now be described in detail with reference to FIGS. 26 to 29.

Figure 26:
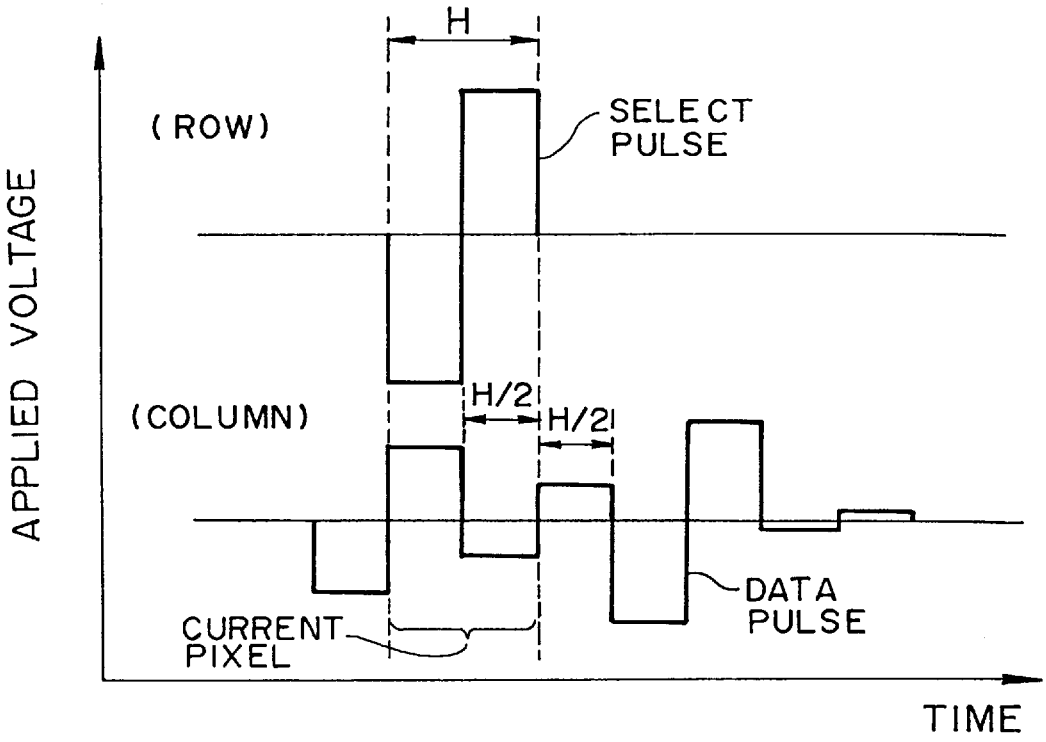
FIG. 26 is a graph including a driving waveform applied to a row electrode and a driving waveform applied to a column electrode, in which one of the waveforms is synchronized with the other by shifting H/2 in another embodiment in accordance with the present invention.

Using a ferroelectric liquid crystal display device (liquid crystal panel) prepared as in the first embodiment, a pair of bipolar select pulses having the same waveform as the first embodiment are applied to the row electrode group, and a data-pulse sequence having a driving waveform is applied to the select-electrode group to determine applied voltage vs. transmittance as shown in FIG. 26, in which the driving waveform of the bipolar data-pulse sequence is synchronized with a pair of bipolar select pulses by shifting H/2 (1/2 line). In this driving waveform, the bipolar data-pulse sequence therefore has opposite polarity to the bipolar select pulses.

Figure 27:
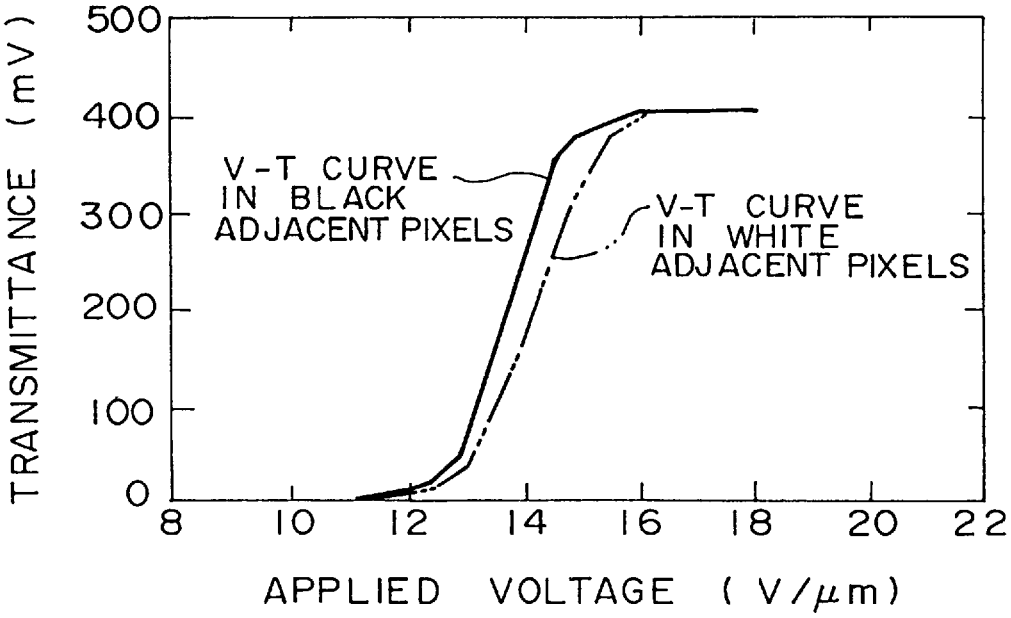
FIG. 27 is a graph including a V-T curve when the adjacent pixels are black and a V-T curve when the adjacent pixels are white in a liquid crystal display device, in which the driving waveforms shown in FIG. 26 are used.

As a result, the shift of the V-T curve due to the bias voltage is suppressed without a change in the minimum threshold voltage as shown in FIG. 27, and such a trend is noticeable at a lower voltage (for example, in switching from white to black). The graph shown in FIG. 27 demonstrates that satisfactory gradation can be achieved, and the shift due to bias voltage is greatly affected by the next line. The voltage corresponding to the current pixel is always applied during a first ½ time period for the next line by shifting by H/2 pulses as shown in FIG. 26, and effects of the reversed electric field are uniquely determined. Further, the image quality deterioration, such as reduction of horizontal lines, does not occur since the data pulse sequence corresponding to the current pixel is applied immediately a after the select pulses are applied.

Figure 28:
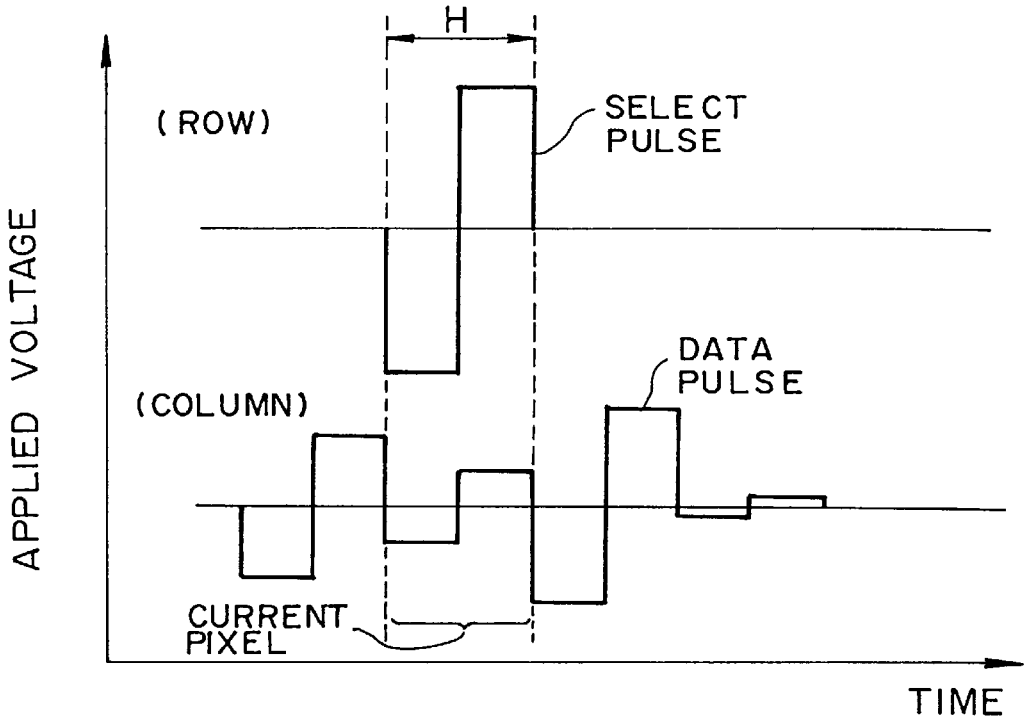
FIG. 28 is a graph including a driving waveform applied to a row electrode and a driving waveform applied to a column electrode, in which the two waveforms are synchronized without shifting.
Figure 29:
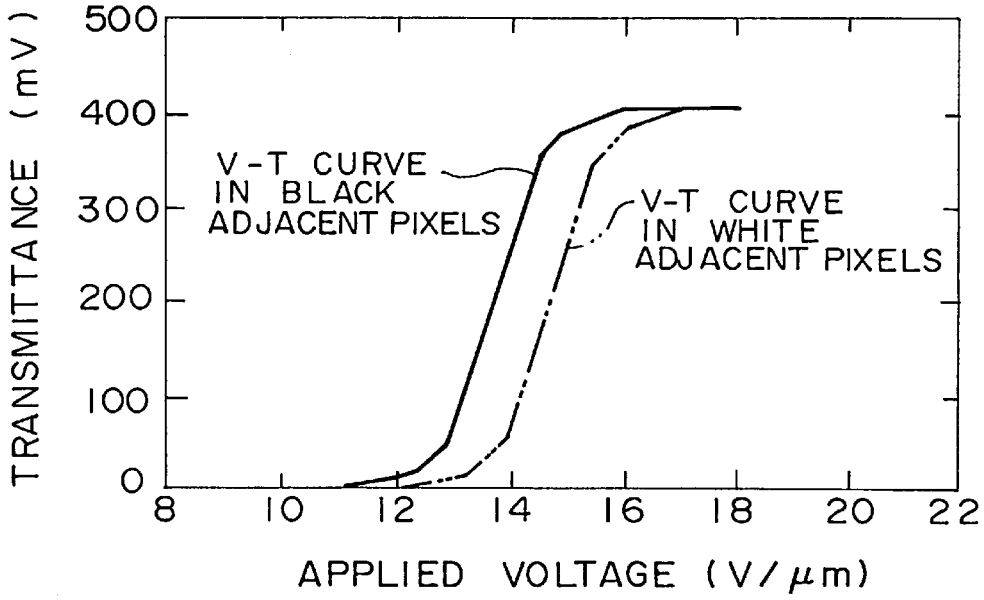
FIG. 29 is a graph including a V-T curve when the adjacent pixels are black and a V-T curve when the adjacent pixels are white in a liquid crystal display device, in which the driving waveforms shown in FIG. 28 are used.

In contrast, in the driving waveform as shown in FIG. 28, a data-pulse sequence having the same polarity as the select pulses is applied to the column electrode group. Each pixel therefore has various data voltage values greatly affected by the bias voltage and a large shift due to bias voltage.

For comparison, a driving waveform having the same polarity as the select pulses as shown in FIG. 28 is used as a bipolar data-pulse sequence in a ferroelectric liquid crystal display device (liquid crystal panel) prepared by the same process. An applied voltage vs. transmittance curve in this case is given in FIG. 29. A V-T curve when the adjacent pixels are black greatly shifts from a V-T curve when the adjacent pixels are white, only two values, i.e., white and black, are controllable in this driving process.

Third Embodiment

A ferroelectric liquid crystal display device in accordance with the third embodiment will now be described in de tail with reference to FIGS. 30 to 34.

It has been found that an additivity stands up between the reversed electric field due to unrelaxation of spontaneous polarization, which is a characteristic of ferroelectric liquid crystals, after switching and a voltage to be applied next. The effective voltage therefore shifts to the low voltage side when the data pulse of the next line has positive polarity, or to the high voltage side when the data pulse has negative polarity. Further, the effective voltage decreases with the elapsed time period. For example, an applied voltage of 1 V after 1 μsec. has a different effect from 1 V after 2 μsec.

Figure 30:
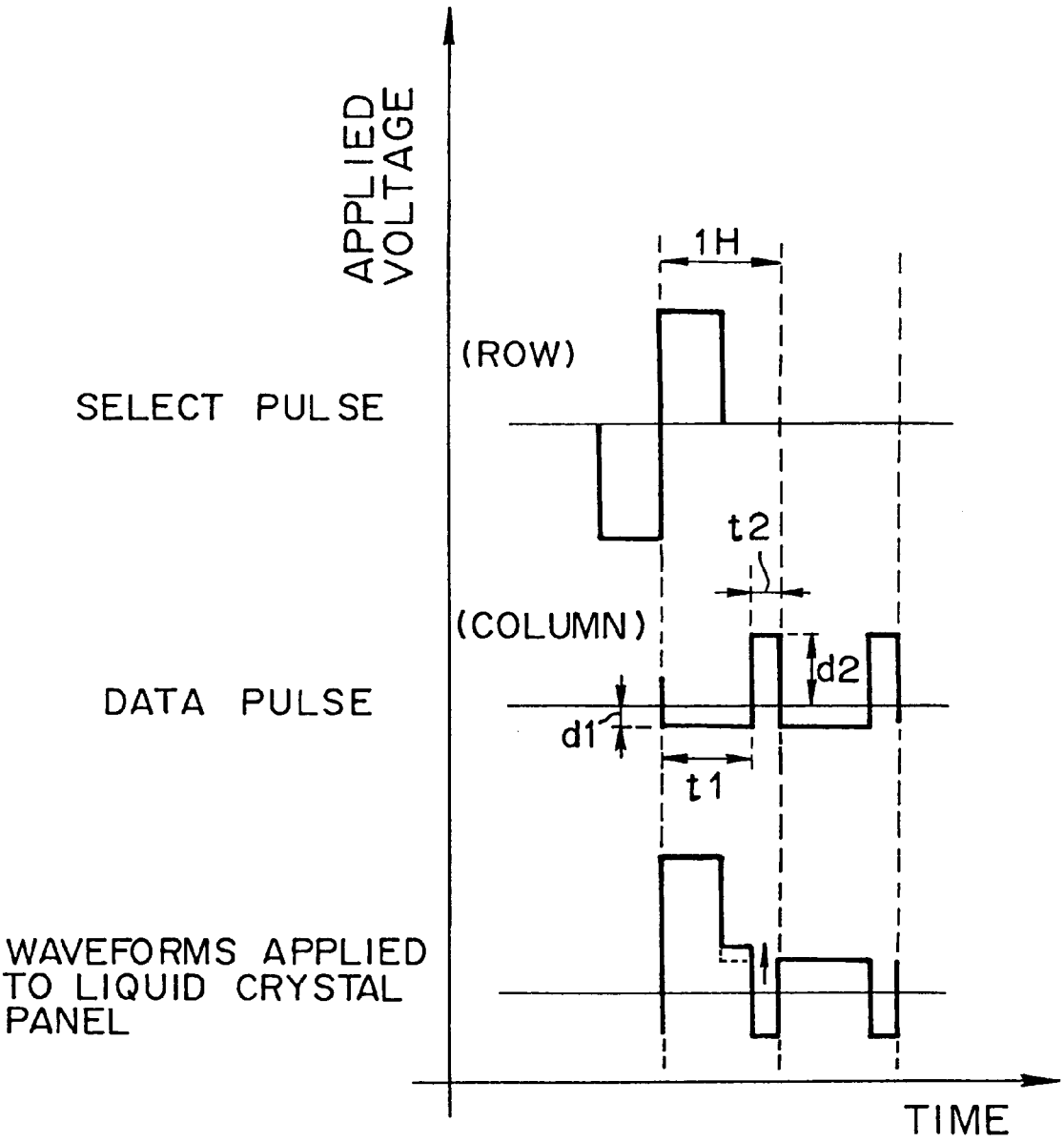
FIG. 30 is a graph of driving waveforms for illustrating the ratio of a pair of bipolar data pulses in another embodiment in accordance with the present invention.
Figure 31:
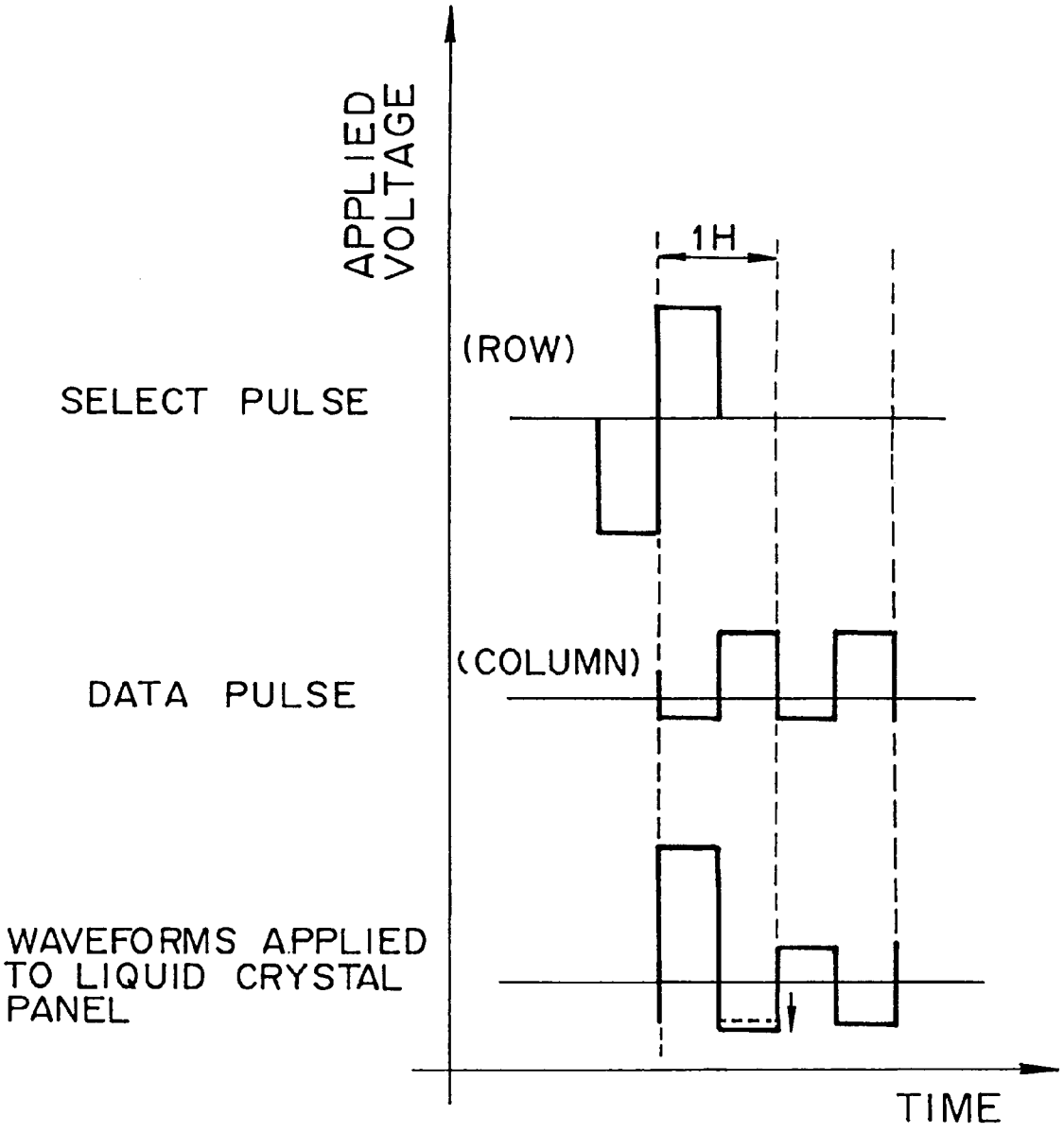
FIG. 31 is a graph of driving waveforms for comparison in which the ratio of the bipolar data pulses is varied.
Figure 32:
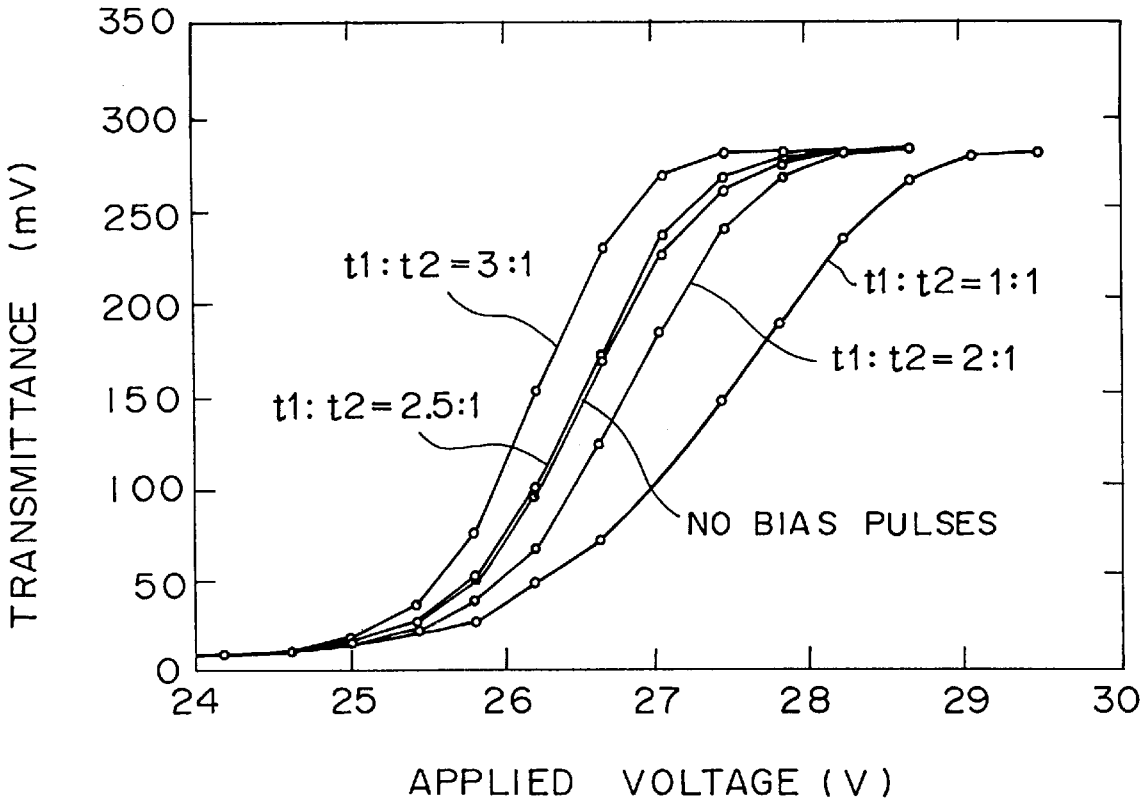
FIG. 32 is a graph illustrating V-T curves at different ratios of data pulses.

Waveforms of the select pulse and the data-pulse sequence have been invented as shown in FIG. 30 based on the above-mentioned phenomena. Set $d_1 \times t_1 = d_2 \times t_2$ wherein $d_1$ and $t_1$ represent height and width of the bipolar data pulse voltage having negative polarity, and $d_2$ and $t_2$ represent height and width of the bipolar data pulse voltage having positive polarity in a ferroelectric liquid crystal device (liquid crystal panel) prepared as in the first embodiment. Asymmetry of the data voltage and shift width of the data voltage due to a bias voltage are measured at various $t_1/t_2$ ratios. The results are shown in FIG. 32.

Figure 33:
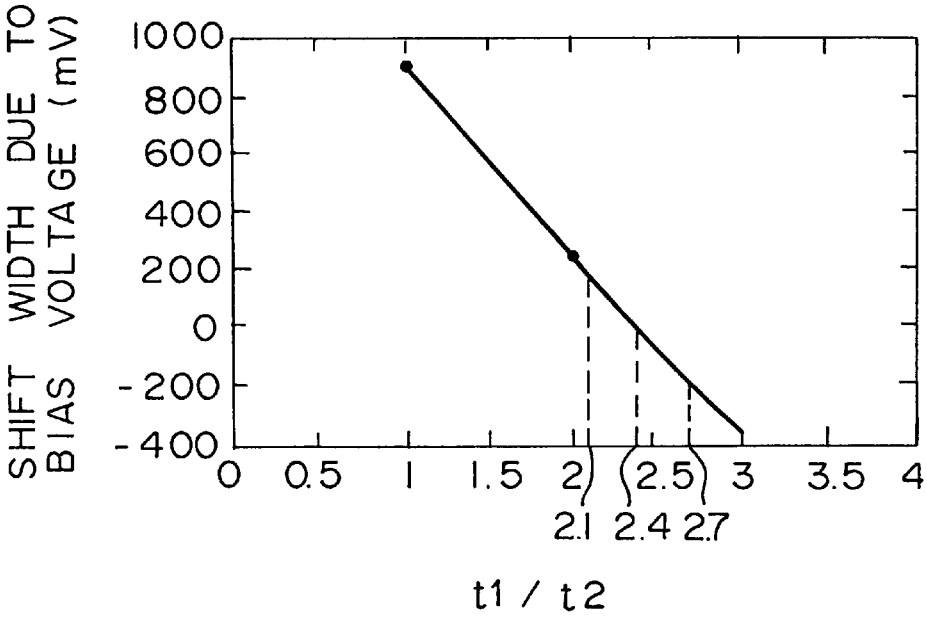
FIG. 33 is a graph illustrating the correlation between the ratio of data pulses and shift width due to a bias voltage.
Figure 34:
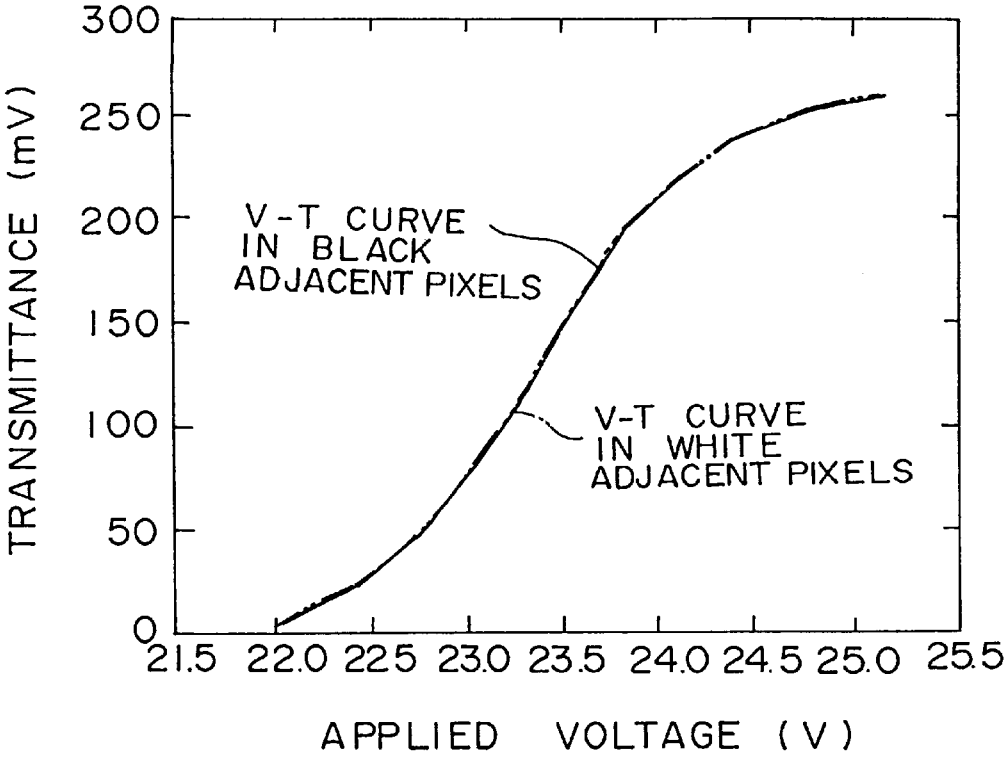
FIG. 34 is a graph including a V-T curve when the adjacent pixels are black and a V-T curve when the adjacent pixels are white, in which a driving waveform with an optimized data pulse ratio is used in a liquid crystal display device.

As shown in the second embodiment, the threshold voltage is constant since the data voltage of the selected pixel is applied to the next line. FIG. 33 is a graph illustrating the correlation between the $t_1/t_2$ ratio and the shift width due to a bias voltage. FIG. 33 demonstrates that the correlation between the $t_1/t_2$ ratio and the shift width substantially has a liner function and the $t_1/t_2$ ratio must be larger than 1. It is preferable that the $t_1/t_2$ ratio be in a range of 2.1 to 2.7 in order to achieve 16 gradations or more. When the $t_1/t_2$ ratio is 2.4, a shift width of zero can be achieved. The results are shown in FIG. 34. The graph in FIG. 34 demonstrates that no shift due to a bias voltage is observed an d a unique transmittance is obtainable regardless of the neighboring color (analog gradation can be achieved).

The select pulse width is set to H/2 in t he above-described embodiment, but is not limited to H/2. The shift due to a bias voltage can also be suppressed by optimizing the $d_1/d_2$ ratio.

When $t_1/t_2 > 1$ and most preferably $t_1/t_2 = 2.4$ as in this embodiment, the data-pulse sequence holds bipolar negative voltages after applying the select pulse. The reversed electric field due to the select pulse therefore is offset by the data pulse. When the data pulse has positive polarity after switching, the effective voltage shifts from the broken line to the lower voltage side due to the reversed electric field, resulting in a change in transmittance. On the other hand, when the data pulse has negative polarity after switching, the effective voltage shifts toward the higher voltage due to the reversed electric field. The change in transmittance due to a bias voltage therefore can be significantly decreased.

The above-mentioned embodiments can be modified based on the technical idea in the present invention.

For example, the above-mentioned driving waveforms including that of the data pulse can be modified within the scope of the present invention. Applicable driving systems include a passive-matrix system and an active matrix system.

The type of the liquid crystal, combination of liquid crystals, and components and physical properties of fine particles can also be changed. Examples of usable constituents other than ITO for transparent electrodes include known transparent electrode materials, such as tin oxide and indium oxide. Also known transparent substrates, spacers, sealing agents and other materials for liquid crystals can be used.

The liquid crystal device in accordance with the present invention is applicable to light shutters, light switches, light blinds and the like, as well as displays. Also it is applicable to liquid crystal prisms, liquid crystal lenses, light path switches, light modulators, phase diffraction gratings, A/D converters and light logic circuits in combination with electrooptical devices.

What is claimed is:

1. A driving method of a liquid crystal device comprising a first substrate provided with a unidirectionally aligned data-electrode group and a second substrate provided with a select-electrode group aligned perpendicularly to said data electrode, wherein after a select pulse is applied to said select electrodes, a pause corresponding to at least one line is provided before a data-pulse sequence is applied to said data-electrode group.

2. A driving method of a liquid crystal device according to claim 1, wherein a pause corresponding to 1 to 2 lines is provided before said data pulse is applied.

3. A driving method of a liquid crystal device according to claim 1, wherein said data pulse is a bipolar pulse corresponding to 1 line.

4. A driving method of a liquid crystal device according to claim 1, wherein said liquid crystal is a ferroelectric liquid crystal in which fine domains having different threshold voltages for switching said ferroelectric liquid crystal are distributed.

5. A driving method of a liquid crystal device comprising a first substrate provided with a unidirectionally aligned data-electrode group and a second substrate provided with a select-electrode group aligned perpendicularly to said data electrode, wherein a select pulse applied to said select-electrode group is synchronized with a data-pulse sequence applied to said data-electrode group by shifting them a half line (H/2) relative to each other so that said select pulse and said data pulse have opposite polarity in relation to each other, and said liquid crystal is a ferroelectric crystal in which fine domains having different threshold voltages for switching said ferroelectric liquid crystal are distributed.

6. A driving method of a liquid crystal device comprising a first substrate provided with a unidirectionally aligned data-electrode group and a second substrate provided with a select-electrode group aligned perpendicularly to said data electrode, wherein a select pulse is applied to said select-electrode group while a data pulse, in which the time and/or the voltage is determined so as to offset the effects of the reversed electric field generated during switching of said liquid crystal, is applied to said data-electrode group, wherein said data pulse has a larger pulse width than that of said select pulse.

7. A driving method of a liquid crystal device according to claim 6, wherein said data pulse has opposite polarity than that of the select pulse.

8. A driving method of a liquid crystal device according to claim 6, wherein the data pulse width $t_1$ to be applied when said select pulse is applied and the data pulse width $t_2$ having opposite polarity to be applied after said data pulse is applied to said data-electrode group satisfy the following equation:

$$t_1/t_2>1$$

9. A driving method of a liquid crystal device according to claim 8, wherein said $t_1$ and said $t_2$ satisfy the following equation:

$$t_1/t_2=2.1 \text{ to } 2.7$$

10. A driving method of a liquid crystal device according to claim 6, wherein said liquid crystal is a ferroelectric liquid crystal in which fine domains having different threshold voltages for switching said ferroelectric liquid crystal are distributed.

11. A driving method of a liquid crystal device comprising a first substrate provided with a unidirectionally aligned data-electrode group and a second substrate provided with a select-electrode group aligned perpendicularly to said data electrode, wherein a select pulse applied to said select-electrode group is synchronized with a data-pulse sequence applied to said data-electrode group by shifting them a half line (H/2) relative to each other so that said select pulse and said data pulse have opposite polarity in relation to each other, and a select pulse is applied to said select-electrode group while a data pulse, in which the time and/or the voltage is determined so as to offset the effects of the reversed electric field generated during switching of said liquid crystal, is applied to said data-electrode group, and wherein said liquid crystal is a ferroelectric liquid crystal in which fine domains having different threshold voltages for switching said ferroelectric liquid crystal are distributed.

12. A driving method of a liquid crystal device according to claim 11, wherein said data pulse has opposite polarity and a larger pulse width than that of the select pulse.

13. A driving method of a liquid crystal device according to claim 11, wherein the data pulse width $t_1$ to be applied when said select pulse is applied and the data pulse width $t_2$ having opposite polarity to be applied after said data pulse is applied to said data-electrode group satisfy the following equation:

$$t_1/t_2>1$$

14. A driving method of a liquid crystal device according to claim 13, wherein said $t_1$ and said $t_2$ satisfy the following equation:

$$t_1/t_2=2.1 \text{ to } 2.7$$

* * * * *